US005538825A

United States Patent [19]

Pundsack et al.

[11] Patent Number: 5,538,825

[45] Date of Patent: Jul. 23, 1996

[54] PRINTING PLATE PREPARATION PROCESS

[75] Inventors: Arnold L. Pundsack, Georgetown; Hardy Sonnenberg, Freelton; Man C. Tam, Mississauga, all of Canada

[73] Assignee: Xerox Corporation, Stamford, Conn.

[21] Appl. No.: 537,989

[22] Filed: Oct. 2, 1995

[51] Int. Cl.[6] ..... G03G 13/22

[52] U.S. Cl. ..... 430/41; 430/49

[58] Field of Search ..... 430/41, 49

[56] References Cited

U.S. PATENT DOCUMENTS

| | | | |
|---|---|---|---|
| 3,820,984 | 6/1974 | Gundlack | 96/1 PS |
| 4,230,782 | 2/1980 | Goffe | 430/41 |
| 4,518,668 | 5/1985 | Nakayama | 430/49 |
| 4,532,197 | 7/1985 | Humberstone et al. | 430/41 |
| 4,761,443 | 8/1988 | Lopes | 524/110 |
| 4,762,764 | 8/1988 | Ng et al. | 430/115 |
| 4,937,163 | 6/1990 | Tam et al. | 430/41 |
| 5,102,756 | 4/1992 | Vincett et al. | 430/41 |

OTHER PUBLICATIONS

Journal of Imaging Technology vol. 10, #5, Oct./1984, pp. 190–196 "Application of Xerox Dry Microfilm (XPM), a Camera Speed, Hyda Resolution, Nonsitner", Film Wet Indust. Dry Development, A. L. Punders et al.

*Primary Examiner*—John Goodrow
*Attorney, Agent, or Firm*—Judith L. Byorick

[57] ABSTRACT

Disclosed is a process which comprises (a) providing a migration imaging member which comprises a substrate and a softenable layer comprising a softenable material and a photosensitive migration marking material; (b) providing a printing plate precursor which comprises a base layer and a layer of photosensitive material selected from the group consisting of photohardenable materials and photosoftenable materials; (c) placing the softenable layer of the migration imaging member in contact with the layer of photosensitive material of the printing plate precursor and applying heat and pressure to the migration imaging member and printing plate precursor, thereby causing the softenable layer of the migration imaging member to adhere to the layer of photosensitive material of the printing plate precursor; (d) uniformly charging the migration imaging member; (e) subsequent to step (d), exposing the charged imaging member to activating radiation at a wavelength to which the migration marking material is sensitive; (f) subsequent to step (e), causing the softenable material to soften and enabling the migration marking material to migrate through the softenable material in an imagewise pattern, thereby resulting in the layer of softenable material becoming transmissive to light in areas where the migration marking material has migrated and remaining nontransmissive to light in areas where the migration marking material has not migrated; (g) subsequent to step (f), uniformly exposing the migration imaging member and the printing plate precursor to radiation at a wavelength to which the photosensitive material on the printing plate precursor is sensitive, thereby causing the photosensitive material on the printing plate precursor to harden or soften in areas situated contiguous with light-transmissive areas of the softenable layer, thereby forming an imaged printing plate; and (h) subsequent to step (g), removing the migration imaging member from the imaged printing plate.

20 Claims, 12 Drawing Sheets

PRINTING PLATE PREPARATION PROCESS

BACKGROUND OF THE INVENTION

The present invention is directed to a process for preparing a printing plate. More specifically, the present invention is directed to a process for preparing a printing plate by exposure to radiation which photohardens or photosoftens a photosensitive layer on a printing plate precursor in an imagewise fashion. One embodiment of the present invention is directed to a process which comprises (a) providing a migration imaging member which comprises a substrate and a softenable layer comprising a softenable material and a photosensitive migration marking material; (b) providing a printing plate precursor which comprises a base layer and a layer of photosensitive material selected from the group consisting of photohardenable materials and photosoftenable materials; (c) placing the softenable layer of the migration imaging member in contact with the layer of photosensitive material of the printing plate precursor and applying heat and pressure to the migration imaging member and printing plate precursor, thereby causing the softenable layer of the migration imaging member to adhere to the layer of photosensitive material of the printing plate precursor; (d) uniformly charging the migration imaging member; (e) subsequent to step (d), exposing the charged imaging member to activating radiation at a wavelength to which the migration marking material is sensitive; (f) subsequent to step (e), causing the softenable material to soften and enabling the migration marking material to migrate through the softenable material in an imagewise pattern, thereby resulting in the layer of softenable material becoming transmissive to light in areas where the migration marking material has migrated and remaining nontransmissive to light in areas where the migration marking material has not migrated; (g) subsequent to step (f), uniformly exposing the migration imaging member and the printing plate precursor to radiation at a wavelength to which the photosensitive material on the printing plate precursor is sensitive, thereby causing the photosensitive material on the printing plate precursor to harden or soften in areas situated contiguous with light-transmissive areas of the softenable layer, thereby forming an imaged printing plate; and (h) subsequent to step (g), removing the migration imaging member from the imaged printing plate. The migration imaging member can be separated from the printing plate by physically peeling the two structures apart. Alternatively, the printing plate can be exposed to a solvent in which the softenable material and photosensitive material in its soft form are either soluble or are softened sufficiently to enable their removal from the base layer by wiping or brushing, and in which photosensitive material in its hard form is not soluble, thereby removing from the base layer all materials except for the hardened photohardenable material, which remains on the base layer in imagewise pattern. Alternatively, if desired, the plate can subsequently be exposed to an etchant that etches the base material in areas not covered by the photohardenable material, followed by removal of the hardened photohardenable material from the base layer, leaving the base layer etched in an imagewise pattern. This etching process is often used for processing lithographic printing plates of the deep-etch or bimetallic type, as disclosed in, for example, *The Lithographer's Manual*, 7th Ed., R. N. Blair, ed., Graphic Arts Technical Foundation, Pittsburgh (1983), the disclosure of which is totally incorporated herein by reference.

In conventional lithographic printing processes, printing plates are frequently prepared by first forming on conventional silver halide film an image corresponding in size to the desired size of the images to be generated, generally by photographing a paste-up of the desired image. Subsequent to development of the silver halide film, the film is transmissive to light in some areas and absorbing to light in other areas in an imagewise pattern. A printing plate precursor, which typically comprises a base layer and a layer of photohardenable material, such as a diazo compound or diazo sensitizer in an organic colloid or synthesized polymer, or a polymer that becomes crosslinked upon exposure to light, is then placed in contact with the developed silver halide film, and light, generally within the ultraviolet wavelength range, is directed onto the silver halide film. The light passes through the silver halide film mask to the photohardenable material in areas of the film that are transmissive to light, and the photohardenable material exposed to light becomes hardened while unexposed areas of the photohardenable material remain unhardened. Subsequently, the precursor is exposed to a solvent in which the hardened form of the photohardenable material is insoluble and the unhardened form of the photohardenable material is soluble, thus washing away the unhardened material and leaving the hardened material on the base layer in a pattern corresponding to the desired image. The hardened photohardenable material is typically hydrophobic, while the base layer is generally hydrophilic, although the base layer can be selected to be hydrophobic and the hardened photopolymeric material can be selected to be hydrophilic. Thus, when the printing plate thus formed is contacted with an oil-based ink, the ink remains on portions of the plate containing the hardened photohardenable material but is repelled by the base plate material. Contacting the plate with an ink and then contacting the inked plate with a printing substrate thus generates prints of the desired image. Alternatively, the ink image on the plate can be applied to an offset roller and the ink on the offset roller subsequently applied to the printing substrate. Further, instead of using a photohardenable material on the base plate, a hydrophobic photodegradable material can be used in which the exposed areas can be removed on development. Plate coatings of the type described are generally negative working in that the light exposed areas become photohardened and ink receptive and form the image areas. The plate coatings, however, can also be positive working. In this instance, the exposed areas are photodegraded and washed away on development and become the hydrophilic or non-image areas of the plate. The unexposed areas remain after development and require fixing to render them light insensitive. These areas generally are hydrophobic and ink receptive and hence form the image areas.

These known processes have the disadvantage that generation of the desired image on silver halide film prior to exposing the printing plate results in added expense and processing times for printing processes wherein formation of a silver halide image is not otherwise necessary or desirable, such as digital pagination systems wherein the image is computer generated. Accordingly, a printing plate precursor that can be exposed directly by, for example, a scanning laser driven by a digital page file, would exhibit advantages such as convenience, rapid processing time, and lower cost. While it may be possible to expose a conventional printing plate by such a process, the exposure generally would require very high power lasers, which tend to be expensive and short-lived. Further, while it may be possible to employ conventional argon ion or helium-cadmium lasers to expose a printing plate comprising a series of photographic type silver halide emulsions on a paper base, these plates are often short-lived during the printing process. One type of direct imaging plate is described in *The Lithographer's Manual*, 7th Ed., R. N. Blair, ed., page 10:28, Graphic Arts Technical Foundation, Pittsburgh (1983). Because there is only a small difference between the ink and water receptivity of the image and nonimage areas on this type of plate, it is difficult to achieve optimal conditions with respect to exposure, processing, and printing on a press. With considerable care, acceptable results can be obtained as long as the contrast range of the copy is not too great; it is difficult to mix line, halftone, and solid areas on one plate, as each requires different levels of exposure or different inks for optimum printing results. Thus, a printing plate having the printing characteristics of a conventional printing plate but capable of camera speed exposure for the initial exposure is particularly desirable and is provided by the present invention.

U.S. Pat. No. 4,532,197 (Humberstone et al.) discloses a method of forming an image on an electrophotographic film material. The process entails a contact printing technique and comprises placing an image-bearing master in contact with the film, exposing the film to light through the image-bearing master, the exposure being substantially greater than the minimum necessary to render conductive the photoconductive layer of the electrophotographic film, applying a substantially uniform charge to the surface of the film in the dark immediately after exposure, leaving the film in the dark for a short time so as to allow the charge to migrate selectively, and then developing the image.

U.S. Pat. No. 4,230,782 (Goffe), the disclosure of which is totally incorporated herein by reference, discloses a migration imaging system wherein an imaging member comprising migration marking material contained in or contacting a softenable layer on a supporting substrate has a latent image formed thereon, and the imaging member is subsequently developed by passing it through one or more small meniscuses bonding at least in part a volume of liquid which is capable of changing the resistance of the softenable material, to enable the migration marking material to migrate toward the substrate. Alternately, an imaged migration imaging member having marking material in a migrated image configuration and in a background configuration, which is at least in part spaced apart in depth in the softenable layer from the image configuration, is further developed by this system to enhance image quality.

U.S. Pat. No. 4,762,764 (Ng et al.) discloses a liquid developer suitable for developing electrostatic latent images either on dielectric paper or on an electroreceptor or photoreceptor substrate. In Examples 1, 3, and 6 to 10 of the patent, the liquid developer is used to develop images on a migration imaging member.

"Applications of Xerox Dry Microfilm (XDM), a Camera-Speed, High Resolution, Nonsilver Film with Instant, Dry Development," A. L. Pundsack, P. S. Vincett, P. H. Soden, M. C. Tam, G. J. Kovacs, and D. S. Ng, *Journal of Imaging Technology*, vol. 10, no. 5, pages 190 to 196 (October 1984), the disclosure of which is totally incorporated herein by reference, discloses migration imaging members and the imaging steps associated therewith. This article also discloses the use of a migration imaging member instead of silver halide film as a film intermediate in the formation of printing plates. In addition, this article proposes a printing plate comprising a substrate and a migration imaging member, wherein an electrostatic toning process is employed to create the required ink-attracting properties in the image areas and ink repelling properties in the nonimage areas. Since the softenable matrix polymer is generally hydrophobic, the toner should be hydrophilic. The toner can be fused to the matrix polymer surface to form the printing plate. In contrast to the printing processes described in this article, the present invention entails exposing to light a conventional printing plate through a migration imaging member which is subsequently removed prior to employing the exposed printing plate in printing processes, resulting in formation of a conventional printing plate.

U.S. Pat. Nos. 3,820,984 (Gundlach) and 3,648,607 (Gundlach), the disclosures of each of which are totally incorporated herein by reference, disclose a migration imaging system having a migration imaging member with a binder layer of softenable material wherein a mixture of electrically photosensitive and inert fusible particles is dispersed and an imaging process wherein the fusible particles are fused, thereby fixing the migrated image of the two types of particles. The imaged member is used as a lithographic printing master.

U.S. Pat. No. 4,518,668 (Nakayama), the disclosure of which is totally incorporated herein by reference, discloses a method for preparing a lithographic printing plate by providing a light-sensitive material comprising an electroconductive support having a hydrophilic surface and a light sensitive layer and a photoconductive insulating layer thereon. The material is imagewise exposed and then subjected to electrophotographic processing to form an electrostatic latent image on the photoconductive insulating layer. After exposure, the electrostatic latent image is developed with developer particles which are opaque to the light to which the light sensitive layer is sensitive in the presence of an electrode facing the photoconductive insulating layer. The development is carried out while applying a bias voltage between the electrode and the light-sensitive layer so that the residual charge on the non-latent areas appears zero. The exposed or unexposed areas of the light sensitive layer are then removed together with the photoconductive insulating layer, resulting in a lithographic printing plate.

U.S. Pat. No. 5,102,756 (Vincett et al.), the disclosure of which is totally incorporated herein by reference, discloses a printing plate precursor which comprises a base layer, a layer of photohardenable material, and a layer of softenable material containing photosensitive migration marking material. Alternatively, the precursor can comprise a base layer and a layer of softenable photohardenable material containing photosensitive migration marking material. Also disclosed are processes for preparing printing plates from the disclosed precursors.

U.S. Pat. No. 4,937,163 (Tam et al.) discloses an imaging member which comprises an ionically conductive film forming polymer, such as sulfonated polystyrene, and an electrically insulating softenable layer comprising a fracturable layer containing electrically photosensitive migration marking particles.

U.S. Pat. No. 4,761,443 (Lopes) discloses a method for molding high water, high resiliency (HR) polyurethane foam articles wherein a silicone mold release composition is used to treat the surfaces of a mold. The composition imparts release characteristics to the mold which last through multiple molding cycles, allow recoating with said composition and allows the production of defect-free foam articles. The composition consists essentially of a high and a low molecular weight hydroxyl endblocked polydimethylsiloxane, a siloxane crosslinker having Sill functionality, a catalyst and an inert solvent.

Migration imaging systems capable of producing high quality images of high optical contrast density and high resolution have been developed. Such migration imaging systems are disclosed in, for example, U.S. Pat. Nos. 5,215,838, 5,202,206, 5,102,756, 5,021,308, 4,970,130, 4,937,163, 4,883,731, 4,880,715, 4,853,307, 4,536,458, 4,536,457, 4,496,642, 4,482,622, 4,281,050, 4,252,890, 4,241,156, 4,230,782, 4,157,259, 4,135,926, 4,123,283, 4,102,682, 4,101,321, 4,084,966, 4,081,273, 4,078,923, 4,072,517, 4,065,307, 4,062,680, 4,055,418, 4,040,826, 4,029,502, 4,028,101, 4,014,695, 4,013,462, 4,012,250, 4,009,028, 4,007,042, 3,998,635, 3,985,560, 3,982,939, 3,982,936, 3,979,210, 3,976,483, 3,975,739, 3,975,195, and 3,909,262, the disclosures of each of which are totally incorporated herein by reference, and in "Migration Imaging Mechanisms, Exploitation, and Future Prospects of Unique Photographic Technologies, XDM and AMEN", P. S. Vincett, G. J. Kovacs, M. C. Tam, A. L. Pundsack, and P. H. Soden, *Journal of Imaging Science* 30 (4) July/August, pp. 183–191 (1986), the disclosure of which is totally incorporated herein by reference.

The expression "softenable" as used herein is intended to mean any material which can be rendered more permeable, thereby enabling particles to migrate through its bulk. Conventionally, changing the permeability of such material or reducing its resistance to migration of migration marking material is accomplished by dissolving, swelling, melting, or softening, by techniques, for example, such as contacting with heat, vapors, partial solvents, solvent vapors, solvents, and combinations thereof, or by otherwise reducing the viscosity of the softenable material by any suitable means.

The expression "fracturable" layer or material as used herein means any layer or material which is capable of breaking up during development, thereby permitting portions of the layer to migrate toward the substrate or to be otherwise removed. The fracturable layer is preferably particulate in the various embodiments of the migration imaging members. Such fracturable layers of marking material are typically contiguous to the surface of the softenable layer spaced apart from the substrate, and such fracturable layers can be substantially or wholly embedded in the softenable layer in various embodiments of the imaging members.

The expression "contiguous" as used herein is intended to mean in actual contact, touching, also, near, though not in contact, and adjoining, and is intended to describe generically the relationship of the fracturable layer of marking material in the softenable layer with the surface of the softenable layer spaced apart from the substrate.

The expression "optically sign-retained" as used herein is intended to mean that the dark (higher optical density) and light (lower optical density) areas of the visible image formed on the migration imaging member correspond to the dark and light areas of the illuminating electromagnetic radiation pattern.

The expression "optically sign-reversed" as used herein is intended to mean that the dark areas of the image formed on the migration imaging member correspond to the light areas of the illuminating electromagnetic radiation pattern and the light areas of the image formed on the migration imaging member correspond to the dark areas of the illuminating electromagnetic radiation pattern.

The expression "optical contrast density" as used herein is intended to mean the difference between maximum optical density ($D_{max}$) and minimum optical density ($D_{min}$) Of an image. Optical density is measured for the purpose of this invention by diffuse densitometers with a blue Wratten No. 94 filter. The expression "optical density" as used herein is intended to mean "transmission optical density" and is represented by the formula:

$$D=\log_{10}[I_o/I]$$

where I is the transmitted light intensity and $I_o$ is the incident light intensity. For the purpose of this invention, all values of transmission optical density given in this invention include the substrate density of about 0.2 which is the typical density of a metallized polyester substrate.

High optical density in migration imaging members allows high contrast densities in migration images made from the migration imaging members. High contrast density is highly desirable for most information storage systems. Contrast density is used herein to denote the difference between maximum and minimum optical density in a migration image. While a slight loss in $D_{max}$ after development is sometimes observed, the maximum optical density value of an imaged migration imaging member is essentially the same value as the optical density of an unimaged migration imaging member.

There are various other systems for forming such images, wherein non-photosensitive or inert marking materials are arranged in the aforementioned fracturable layers, or dispersed throughout the softenable layer, as described in the aforementioned patents, which also disclose a variety of methods which can be used to form latent images upon migration imaging members.

Various means for developing the latent images can be used for migration imaging systems. These development methods include solvent wash away, solvent vapor softening, heat softening, and combinations of these methods, as well as any other method which changes the resistance of the softenable material to the migration of particulate marking material through the softenable layer to allow imagewise migration of the particles in depth toward the substrate. In the solvent wash away or meniscus development method, the migration marking material in the light struck region migrates toward the substrate through the softenable layer, which is softened and dissolved, and repacks into a more or less monolayer configuration. In migration imaging films supported by transparent substrates alone, this region exhibits a maximum optical density which can be as high as the initial optical density of the unprocessed film. On the other hand, the migration marking material in the unexposed region is substantially washed away and this region exhibits a minimum optical density which is essentially the optical density of the substrate alone. Therefore, the image sense of the developed image is optically sign reversed. Various methods and materials and combinations thereof have previously been used to fix such unfixed migration images. One method is to overcoat the image with a transparent abrasion resistant polymer by solution coating techniques. In the heat or vapor softening developing modes, the migration marking material in the light struck region disperses in the depth of the softenable layer after development and this region exhibits $D_{min}$ which is typically in the range of 0.6 to 0.7. This relatively high $D_{min}$ is a direct consequence of the depthwise dispersion of the otherwise unchanged migration marking material. On the other hand, the migration marking material in the unexposed region does not migrate and substantially remains in the original configuration, i.e. a monolayer. In migration imaging films supported by transparent substrates, this region exhibits a maximum optical density ($D_{max}$) of about 1.8 to 1.9. Therefore, the image sense of the heat or vapor developed images is optically sign-retained.

Techniques have been devised to permit optically sign-reversed imaging with vapor development, but these techniques are generally complex and require critically controlled processing conditions. An example of such techniques can be found in U.S. Pat. No. 3,795,512, the disclosure of which is totally incorporated herein by reference.

For many imaging applications, it is desirable to produce negative images from a positive original or positive images from a negative original (optically sign-reversing imaging), preferably with low minimum optical density. Although the meniscus or solvent wash away development method produces optically sign-reversed images with low minimum optical density, it entails removal of materials from the migration imaging member, leaving the migration image largely or totally unprotected from abrasion. Although various methods and materials have previously been used to overcoat such unfixed migration images, the post-development overcoating step can be impractically costly and inconvenient for the end users. Additionally, disposal of the effluents washed from the migration imaging member during development can also be very costly.

The background portions of an imaged member can sometimes be transparentized by means of an agglomeration and coalescence effect. In this system, an imaging member comprising a softenable layer containing a fracturable layer of electrically photosensitive migration marking material is imaged in one process mode by electrostatically charging the member, exposing the member to an imagewise pattern of activating electromagnetic radiation, and softening the softenable layer by exposure for a few seconds to a solvent vapor thereby causing a selective migration in depth of the migration material in the softenable layer in the areas which were previously exposed to the activating radiation. The vapor developed image is then subjected to a heating step. Since the exposed particles gain a substantial net charge (typically 85 to 90 percent of the deposited surface charge) as a result of light exposure, they migrate substantially in depth in the softenable layer towards the substrate when exposed to a solvent vapor, thus causing a drastic reduction in optical density. The optical density in this region is typically in the region of 0.7 to 0.9 (including the substrate density of about 0.2) after vapor exposure, compared with an initial value of 1.8 to 1.9 (including the substrate density of about 0.2). In the unexposed region, the surface charge becomes discharged due to vapor exposure. The subsequent heating step causes the unmigrated, uncharged migration material in unexposed areas to agglomerate or flocculate, often accompanied by coalescence of the marking material particles, thereby resulting in a migration image of very low minimum optical density (in the unexposed areas) in the 0.25 to 0.35 range. Thus, the contrast density of the final image is typically in the range of 0.35 to 0.65. Alternatively, the migration image can be formed by heat followed by exposure to solvent vapors and a second heating step which also results in a migration image with very low minimum optical density. In this imaging system as well as in the previously described heat or vapor development techniques, the softenable layer remains substantially intact after development, with the image being self-fixed because the marking material particles are trapped within the softenable layer.

The word "agglomeration" as used herein is defined as the coming together and adhering of previously substantially separate particles, without the loss of identity of the particles.

The word "coalescence" as used herein is defined as the fusing together of such particles into larger units, usually accompanied by a change of shape of the coalesced particles towards a shape of lower energy, such as a sphere.

While known printing processes are suitable for their intended purposes, a need continues to exist for printing plate precursors and printing processes wherein the plate can be formed without the need for first forming an intermediate on silver halide film. In addition, there is a need for printing plate precursors and printing processes wherein the printing plate can be exposed directly by, for example, a scanning laser driven by a digital page file. Further, a need remains for printing plate precursors and printing processes that exhibit convenience, rapid processing times, and lower cost compared to conventional printing processes employing silver halide film intermediates. There is also a need for printing plate precursors and printing processes wherein the printing plate can be exposed by a conventional laser apparatus wherein the photohardenable layer of the plate is of a conventional material and/or has the same printing characteristics of a conventional plate, such as plate life. A need also exists for printing plate precursors and printing processes wherein the imaging member and the printing plate coexist, thereby improving registration in the formation of multicolor images. Further, there is a need for processes for preparing printing plates with a wide variety of selection for the materials thereof, with no need to match the photosensitive material on the printing plate with the softenable material on a migration imaging member for compatibility.

SUMMARY OF THE INVENTION

It is an object of the present invention to provide printing plate precursors and printing processes with the above advantages.

It is another object of the present invention to provide printing plate precursors and printing processes wherein the plate can be formed without the need for first forming an intermediate on silver halide film.

It is yet another object of the present invention to provide printing plate precursors and printing processes wherein the printing plate can be exposed directly by, for example, a scanning laser driven by a digital page file.

It is still another object of the present invention to provide printing plate precursors and printing processes that exhibit convenience, rapid processing times, and lower cost compared to conventional printing processes employing silver halide film intermediates.

Another object of the present invention is to provide printing plate precursors and printing processes wherein the printing plate can be exposed by a conventional laser apparatus wherein the photohardenable layer of the plate is of a conventional material and/or has the same printing characteristics of a conventional plate, such as plate life.

Yet another object of the present invention is to provide printing plate precursors and printing processes wherein the imaging member and the printing plate coexist, thereby improving registration in the formation of multicolor images.

Still another object of the present invention is to provide processes for preparing printing plates with a wide variety of selection for the materials thereof, with no need to match the photosensitive material on the printing plate with the softenable material on a migration imaging member for compatibility.

These and other objects of the present invention (or specific embodiments thereof) can be achieved by providing a process which comprises (a) providing a migration imaging member which comprises a substrate and a softenable layer comprising a softenable material and a photosensitive migration marking material; (b) providing a printing plate precursor which comprises a base layer and a layer of photosensitive material selected from the group consisting of photohardenable materials and photosoftenable materials; (c) placing the softenable layer of the migration imaging member in contact with the layer of photosensitive material of the printing plate precursor and applying heat and pressure to the migration imaging member and printing plate precursor, thereby causing the softenable layer of the migration imaging member to adhere to the layer of photosensitive material of the printing plate precursor; (d) uniformly charging the migration imaging member; (e) subsequent to step (d), exposing the charged imaging member to activating radiation at a wavelength to which the migration marking material is sensitive; (f) subsequent to step (e), causing the softenable material to soften and enabling the migration marking material to migrate through the softenable material in an imagewise pattern, thereby resulting in the layer of softenable material becoming transmissive to light in areas where the migration marking material has migrated and remaining nontransmissive to light in areas where the migration marking material has not migrated; (g) subsequent to step (f), uniformly exposing the migration imaging member and the printing plate precursor to radiation at a wavelength to which the photosensitive material on the printing plate precursor is sensitive, thereby causing the photosensitive material on the printing plate precursor to harden or soften in areas situated contiguous with light-transmissive areas of the softenable layer, thereby forming an imaged printing plate; and (h) subsequent to step (g), removing the migration imaging member from the imaged printing plate.

DETAILED DESCRIPTION OF THE INVENTION

Figure 1:
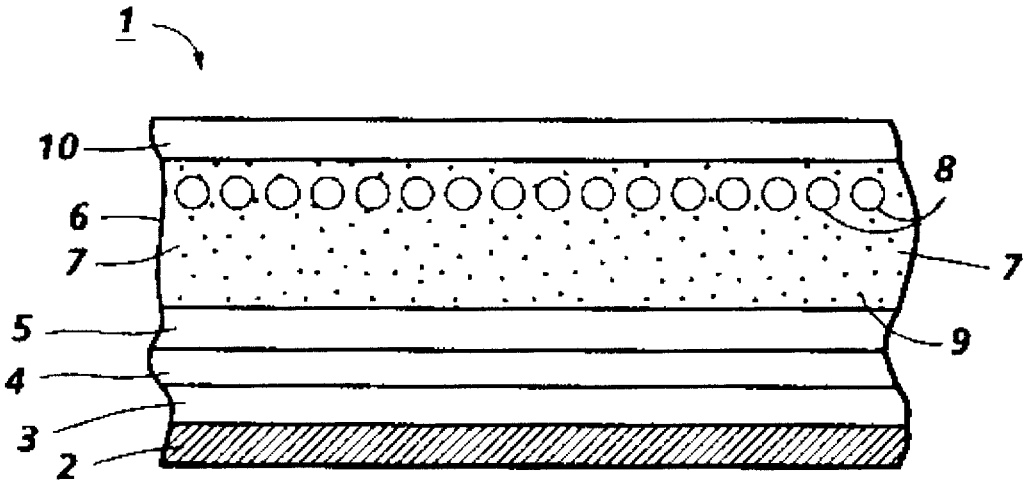
FIG. 1 illustrates schematically one embodiment of a migration imaging member suitable for the process of the present invention.

One example of a migration imaging member suitable for the process of the present invention is illustrated schematically in FIG. 1. As illustrated schematically in FIG. 1, migration imaging member 1 comprises a substrate 2, an optional adhesive layer 3 situated on the substrate 2, an optional charge blocking layer 4 situated on optional adhesive layer 3, an optional charge transport layer 5 situated on optional charge blocking layer 4, and a softenable layer 6 situated on optional charge transport layer 5, said softenable layer 6 comprising softenable material 7, migration marking material 8 situated at or near the surface of the layer spaced from the substrate, and optional charge transport material 9 dispersed throughout softenable material 7. Optional overcoating layer 10 is situated on the surface of softenable layer 6 spaced from the substrate 2. Any or all of the optional layers and materials can be absent from the imaging member. In addition, any of the optional layers present need not be in the order shown, but can be in any suitable arrangement. The migration imaging member can be in any suitable configuration, such as a web, a foil, a laminate, a strip, a sheet, a coil, a cylinder, a drum, an endless belt, an endless mobius strip, a circular disc, or any other suitable form.

The substrate is at least partially transparent, and preferably is substantially transparent, and can be either electrically conductive or electrically insulating. Examples of suitable conductive materials include conductive plastics and rubbers, semitransparent aluminum, indium, tin, metal oxides, including tin oxide and indium tin oxide, and the like. When insulative, the substrate can be of any suitable insulative material, such as glass, plastic, polyesters such as Mylar® (available from Du Pont) or Melinex® 442 (available from ICI Americas, Inc.), and the like. In addition, the substrate can comprise an insulative layer with a conductive coating, such as vacuum-deposited metallized plastic, such as titanized or aluminized Mylar® polyester, wherein the metallized surface is in contact with the softenable layer or any other layer situated between the substrate and the softenable layer. The substrate has any effective thickness, typically from about 6 to about 250 microns, and preferably from about 10 to about 250 microns, although the thickness can be outside these ranges.

The softenable layer can comprise one or more layers of softenable materials, which can be any suitable material, typically a plastic or thermoplastic material which is soluble in a solvent or softenable, for example, in a solvent liquid, solvent vapor, heat, or any combinations thereof. When the softenable layer is to be softened or dissolved either during or after imaging, it should be soluble in a solvent that does not attack the migration marking material. By softenable is meant any material that can be rendered by a development step as described herein permeable to migration material migrating through its bulk. This permeability typically is achieved by a development step entailing dissolving, melting, or softening by contact with heat, vapors, partial solvents, as well as combinations thereof. Examples of suitable softenable materials include styrene-acrylic copolymers, such as styrene-hexylmethacrylate copolymers, styrene acrylate copolymers, styrene butylmethacrylate copolymers, styrene butylacrylate ethylacrylate copolymers, styrene ethylacrylate acrylic acid copolymers, and the like, polystyrenes, including polyalphamethyl styrene, alkyd substituted polystyrenes, styrene-olefin copolymers, styrenevinyltoluene copolymers, polyesters, polyurethanes, polycarbonates, polyterpenes, silicone elastomers, mixtures thereof, copolymers thereof, and the like, as well as any other suitable materials as disclosed, for example, in U.S. Pat. No. 3,975,195 and other U.S. patents directed to migration imaging members which have been incorporated herein by reference. The softenable layer can be of any effective thickness, typically from about 1 to about 30 microns, preferably from about 2 to about 25 microns, and more preferably from about 2 to about 10 microns, although the thickness can be outside these ranges. The softenable layer can be applied to the substrate by any suitable coating process. Typical coating processes include draw bar coating, spray coating, extrusion, dip coating, gravure roll coating, wire-wound rod coating, air knife coating and the like.

The softenable layer also contains migration marking material. The migration marking material can be electrically photosensitive, photoconductive, or of any other suitable combination of materials, or possess any other desired physical property and still be suitable for use in the migration imaging members of the present invention. The migration marking materials preferably are particulate, wherein the particles are closely spaced from each other. Preferred migration marking materials generally are spherical in shape and submicron in size. The migration marking material generally is capable of substantial photodischarge upon electrostatic charging and exposure to activating radiation and is substantiality absorbing and opaque to activating radiation in the spectral region where the photosensitive migration marking particles photogenerate charges. The migration marking material is generally present as a thin lawyer or monolayer of particles situated at or near the surface of the softenable layer spaced from the substrate. When present as particles, the particles of migration marking material preferably have an average diameter of up to 2 microns, and more preferably of from about 0.1 to about 1 micron. The layer of migration marking particles is situated at or near that surface of the softenable layer spaced from or most distant from the substrate. Preferably, the particles are situated at a distance of from about 0.01 to 0.1 micron from the layer surface, and more preferably from about 0.02 to 0.08 micron from the layer surface. Preferably, the particles are situated at a distance of from about 0.005 to about 0.2 micron from each other, and more preferably at a distance of from about 0.05 to about 0.1 micron from each other, the distance being measured between the closest edges of the particles, i.e. from outer diameter to outer diameter. The migration marking material contiguous to the outer surface of the softenable layer is present in any effective amount, preferably from about 5 to about 80 percent by total weight of the softenable layer, and more preferably from about 25 to about 80 percent by total weight of the softenable layer, although the amount can be outside of this range.

Examples of suitable migration marking materials include selenium, alloys of selenium with alloying components such as tellurium, arsenic, antimony, thallium, bismuth, or mixtures thereof, selenium and alloys of selenium doped with halogens, as disclosed in, for example, U.S. Pat. No. 3,312,548, the disclosure of which is totally incorporated herein by reference, and the like, phthalocyanines, and any other suitable materials as disclosed, for example, in U.S. Pat. No. 3,975,195 and other U.S. patents directed to migration imaging members and incorporated herein by reference.

If desired, two or more softenable layers, each containing migration marking particles, can be present in the imaging member as disclosed in copending application U.S. Ser. No. 08/353,461, filed Dec. 9, 1994, entitled "Improved Migration Imaging Members," with the named inventors Edward G. Zwartz, Carol A. Jennings, Man C. Tam, Philip H. Soden, Arthur Y. Jones, Arnold L. Pundsack, Enrique Levy, Ah-Mee Hor, and William W. Limburg, the disclosure of which is totally incorporated herein by reference.

The migration marking particles can be included in the imaging member by any suitable technique. For example, a layer of migration marking particles can be placed at or just below the surface of the softenable layer by solution coating the first conductive layer with the softenable layer material, followed by heating the softenable material in a vacuum chamber to soften it, while at the same time thermally evaporating the migration marking material onto the softenable material in a vacuum chamber. Other techniques for preparing monolayers include cascade and electrophoretic deposition. Another example of a suitable process for depositing migration marking material in the softenable layer is vacuum evaporation of the migration marking material onto the substrate, as disclosed in, for example, U.S. Pat. No. 4,482,622 and copending application U.S. Ser. No. 08/413,667, the disclosures of each of which are totally incorporated herein by reference.

The migration imaging members can optionally contain a charge transport material in the softenable layer, in a separate charge transport layer, or in other layers therein. When present in the softenable layer, the charge transport material can be any suitable charge transport material either capable of acting as a softenable layer material or capable of being dissolved or dispersed on a molecular scale in the softenable layer material. When a charge transport material is also contained in another layer in the imaging member, preferably there is continuous transport of charge through the entire film structure. The charge transport material is a material which is capable of improving the charge injection process for one sign of charge from the migration marking material into the softenable layer and also of transporting that charge through the softenable layer. The charge transport material can be either a hole transport material (transports positive charges) or an electron transport material (transports negative charges). The sign of the charge used to sensitize the migration imaging member during imaging can be of either polarity. Charge transporting materials are well known in the art. Typical charge transporting materials include the following:

Diamine transport molecules of the type described in U.S. Pat. Nos. 4,306,008, 4,304,829, 4,233,384, 4,115,116, 4,299,897, and U.S. Pat. No. 4,081,274, the disclosures of each of which are totally incorporated herein by reference. Typical diamine transport molecules include N,N'-diphenyl-N,N'-bis(3"-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra-(4-methylphenyl)[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. Nos. 4,315,982, 4,278,746, and U.S. Pat. No. 3,837,851, the disclosures of each of which are totally incorporated herein by reference. Typical pyrazoline transport molecules include 1-[lepidyl-(2)]-3-(p-diethylaminophenyl)-5 -(p-diethylaminophenyl)pyrazoline, 1-[quinolyl-(2)]-3-(p-diethylaminophenyl)-5 -(p-diethylaminophenyl)pyrazoline, 1-[pyridyl-(2)]-3-(p-diethylaminostyryl)-5 -(p-diethylaminophenyl)pyrazoline, 1-[6-methoxypyridyl-(2)]-3-(p-diethylaminostyryl)-5 -(p-diethylaminophenyl)pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021, the disclosure of which is totally incorporated herein by reference. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene)fluorene,2-nitro-9-(4'-diethylaminobenzylidene)fluorene, and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Patent 1,058,836, German Patent 1,060,260, and German Patent 1,120,875, the disclosures of each of which are totally incorporated herein by reference.

Hydrazone transport molecules, such as p-diethylamino benzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthlene-1-carbaldeyde 1-methyl-1 -phenylhydrazone, and the like. Other typical hydrazone transport molecules are described, for example in U.S. Pat. Nos. 4,150,987, 4,385,106, 4,338,388, and U.S. Pat. No. 4,387,147, the disclosures of each of which are totally incorporated herein by reference.

Carbazole phenyl hydrazone transport molecules such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like. Other typical carbazole phenyl hydrazone transport molecules are described, for example, in U.S. Pat. No. 4,256,821 and U.S. Pat. No. 4,297,426, the disclosures of each of which are totally incorporated herein by reference.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butylnaphthalimide as described, for example, in U.S. Pat. No. 3,972,717, the disclosure of which is totally incorporated herein by reference.

Oxadiazole derivatives such as 2,5-bis-(p-diethylaminophenyl)-oxadiazole-1,3,4 described in U.S. Pat. No. 3,895,944, the disclosure of which is totally incorporated herein by reference.

Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described in U.S. Pat. No. 3,820,989, the disclosure of which is totally incorporated herein by reference.

9-Fluorenylidene methane derivatives having the formula

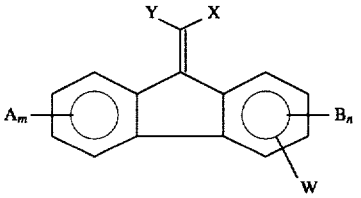

wherein X and Y are cyano groups or alkoxycarbonyl groups; A, B, and W are electron withdrawing groups independently selected from the group consisting of acyl, alkoxycarbonyl, nitro, alkylaminocarbonyl, and derivatives thereof; m is a number of from 0 to 2; and n is the number 0 or 1 as described in U.S. Pat. No. 4,474,865, the disclosure of which is totally incorporated herein by reference. Typical 9-fluorenylidene methane derivatives encompassed by the above formula include (4-n-butoxycarbonyl-9-fluorenylidene)malonontrile, (4-phenethoxycarbonyl-9-fluorenylidene)malonontrile, (4-carbitoxy-9-fluorenylidene)malonontrile, (4-n-butoxycarbonyl-2,7-dinitro-9-fluorenylidene)malonate, and the like.

Other charge transport materials include poly-1-vinylpyrene, poly-9-vinylanthracene, poly-9-(4-pentenyl)-carbazole, poly-9-(5-hexyl)carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole, 3,6-dibromo-poly-N-vinyl carbazole, and numerous other transparent organic polymeric or non-polymeric transport materials as described in U.S. Pat. No. 3,870,516, the disclosure of which is totally incorporated herein by reference. Also suitable as charge transport materials are phthalic anhydride, tetrachlorophthalic anhydride, benzil, mellitic anhydride, S-tricyanobenzene, picrylchloride, 2,4-dinitrochlorobenzene, 2,4-dinitrobromobenzene, 4-nitrobiphenyl, 4,4-dinitrophenyl, 2,4,6-trinitroanisole, trichlorotrinitrobenzene, trinitro-O-toluene, 4,6-dichloro-1,3-dinitrobenzene, 4,6-dibromo-1,3-dinitrobenzene, P-dinitrobenzene, chloranil, bromanil, and mixtures thereof, 2,4,7-trinitro-9-fluorenone, 2,4,5,7-tetranitrofluorenone, trinitroanthracene, dinitroacridene, tetracyanopyrene, dinitroanthraquinone, polymers having aromatic or heterocyclic groups with more than one strongly electron withdrawing substituent such as nitro, sulfonate, carboxyl, cyano, or the like, including polyesters, polysiloxanes, polyamides, polyurethanes, and epoxies, as well as block, graft, or random copolymers containing the aromatic moiety, and the like, as well as mixtures thereof, as described in U.S. Pat. No. 4,081,274, the disclosure of which is totally incorporated herein by reference.

Also suitable are charge transport materials such as triarylamines, including tritolyl amine, of the formula

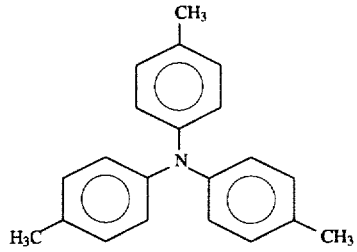

and the like, as disclosed in, for example, U.S. Pat. No. 3,240,597 and U.S. Pat. No. 3,180,730, the disclosures of which are totally incorporated herein by reference, and substituted diarylmethane and triarylmethane compounds, including bis-(4-diethylamino-2-methylphenyl)-phenylmethane, of the formula

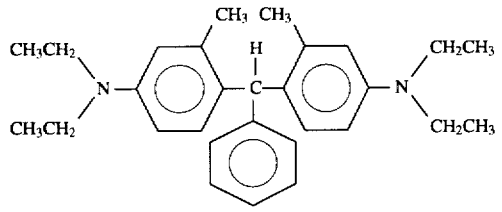

and the like, as disclosed in, for example, U.S. Pat. Nos. 4,082,551, 3,755,310, 3,647,431, British Patent 984,965, British Patent 980,879, and British Patent 1,141,666, the disclosures of which are totally incorporated herein by reference.

When the charge transport molecules are combined with an insulating binder to form the softenable layer, the amount of charge transport molecule which is used can vary depending upon the particular charge transport material and its compatibility (e.g. solubility) in the continuous insulating film forming binder phase of the softenable matrix layer and the like. Satisfactory results have been obtained using between about 5 percent to about 50 percent by weight charge transport molecule based on the total weight of the softenable layer. A particularly preferred charge transport molecule is one having the general formula

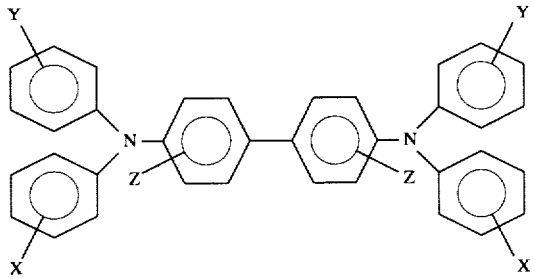

wherein X, Y and Z are selected from the group consisting of hydrogen, an alkyl group having from 1 to about 20 carbon atoms and chlorine, and at least one of X, Y and Z is independently selected to be an alkyl group having from 1 to about 20 carbon atoms or chlorine. If Y and Z are hydrogen, the compound can be named N,N'-diphenyl-N,N'-bis(alkylphenyl)-[1,1'-biphenyl]-4,4'-diamine wherein the alkyl is, for example, methyl, ethyl, propyl, n-butyl, or the like, or the compound can be N,N'-diphenyl-N,N'-bis(chlorophenyl)-[1,1'-biphenyl]-4,4'-diamine. Good results can be obtained when the softenable layer contains between about 5 percent to about 40 percent by weight of these diamine compounds based on the total weight of the softenable layer. Optimum results are achieved when the softenable layer contains between about 8 percent to about 16 percent by weight of N,N'-diphenyl-N,N'-bis(3"-methylphenyl)-(1,1'-biphenyl)-4,4'-diamine based on the total weight of the softenable layer.

The charge transport material is optionally present in the softenable material in any effective amount, typically from about 5 to about 50 percent by weight and preferably from about 8 to about 40 percent by weight, although the amount can be outside these ranges. Alternatively, the softenable layer can employ the charge transport material as the softenable material if the charge transport material possesses the necessary film-forming characteristics and otherwise functions as a softenable material. The charge transport material can be incorporated into the softenable layer by any suitable technique. For example, it can be mixed with the softenable layer components by dissolution in a common solvent. If desired, a mixture of solvents for the charge transport material and the softenable layer material can be employed to facilitate mixing and coating. The charge transport molecule and softenable layer mixture can be applied to the substrate by any conventional coating process. Typical coating processes include draw bar coating, spray coating, extrusion, dip coating, gravure roll coating, wirewound rod coating, air knife coating, and the like.

The optional adhesive layer can include any suitable adhesive material. Typical adhesive materials include copolymers of styrene and an acrylate, polyester resin such as DuPont 49000 (available from E. I. dupont de Nemours Company), copolymer of acrylonitrile and vinylidene chloride, polyvinyl acetate, polyvinyl butyral and the like and mixtures thereof. The adhesive layer can have any thickness, typically from about 0.05 to about 1 micron, although the thickness can be outside of this range. When an adhesive layer is employed, it preferably forms a uniform and continuous layer having a thickness of about 0.5 micron or less to ensure satisfactory discharge during the imaging process. It can also optionally include charge transport molecules.

The optional charge transport layer can comprise any suitable film forming binder material. Typical film forming binder materials include styrene acrylate copolymers, polycarbonates, co-polycarbonates, polyesters, co-polyesters, polyurethanes, polyvinyl acetate, polyvinyl butyral, polystyrenes, alkyd substituted polystyrenes, styrene-olefin copolymers, styrene-co-n-hexylmethacrylate, an 80/20 mole percent copolymer of styrene and hexylmethacrylate having an intrinsic viscosity of 0.179 dl/gm; other copolymers of styrene and hexylmethacrylate, styrene-vinyltoluene copolymers, polyalpha-methylstyrene, mixtures thereof, and copolymers thereof. The above group of materials is not intended to be limiting, but merely illustrative of materials suitable as film forming binder materials in the optional charge transport layer. The film forming binder material typically is substantially electrically insulating and does not adversely chemically react during the imagine process. Although the optional charge transport layer has been described as coated on a substrate, in some embodiments, the charge transport layer itself can have sufficient strength and integrity to be substantially self supporting and can, if desired, be brought into contact with a suitable conductive substrate during the imaging process. As is well known in the art, a uniform deposit of electrostatic charge of suitable polarity can be substituted for a conductive layer. Alternatively, a uniform deposit of electrostatic charge of suitable polarity on the exposed surface of the charge transport spacing layer can be substituted for a conductive layer to facilitate the application of electrical migration forces to the migration layer. This technique of "double charging" is well known in the art. The charge transport layer is of any effective thickness, typically from about 1 to about 25 microns, and preferably from about 2 to about 20 microns, although the thickness can be outside these ranges.

Charge transport molecules suitable for the charge transport layer are described in detail hereinabove. The specific charge transport molecule utilized in the charge transport layer of any given imaging member can be identical to or different from the charge transport molecule employed in the adjacent softenable layer. Similarly, the concentration of the charge transport molecule utilized in the charge transport spacing layer of any given imaging member can be identical to or different from the concentration of charge transport molecule employed in the adjacent softenable layer. When the charge transport material and film forming binder are combined to form the charge transport spacing layer, the amount of charge transport material used can vary depending upon the particular charge transport material and its compatibility (e.g. solubility) in the continuous insulating film forming binder. Satisfactory results have been obtained using between about 5 percent and about 50 percent based on the total weight of the optional charge transport spacing layer, although the amount can be outside this range. The charge transport material can be incorporated into the charge transport layer by techniques similar to those employed for the softenable layer.

The optional charge blocking layer can be of various suitable materials, provided that the objectives of the present invention are achieved, including aluminum oxide, polyvinyl butyral, silane and the like, as well as mixtures thereof. This layer, which is generally applied by known coating techniques, is of any effective thickness, typically from about 0.05 to about 0.5 micron, and preferably from about 0.05 to about 0.1 micron. Typical coating processes include draw bar coating, spray coating, extrusion, dip coating, gravure roll coating, wire-wound rod coating, air knife coating and the like.

The optional overcoating layer can be substantially electrically insulating, or have any other suitable properties. The overcoating preferably is substantially transparent, at least in the spectral region where electromagnetic radiation is used for imagewise exposure step in the imaging process. The overcoating layer is continuous and preferably of a thickness up to about 2 microns. More preferably, the overcoating has a thickness of between about 0.1 and about 0.5 micron to minimize residual charge buildup. Overcoating layers greater than about 1 to 2 microns thick can also be used. Typical overcoating materials include acrylic-styrene copolymers, methacrylate polymers, methacrylate copolymers, styrenebutylmethacrylate copolymers, butylmethacrylate resins, vinylchloride copolymers, fluorinated homo or copolymers, high molecular weight polyvinyl acetate, organosilicon polymers and copolymers, polyesters, polycarbonates, polyamides, polyvinyl toluene and the like. The overcoating layer generally protects the softenable layer to provide greater resistance to the adverse effects of abrasion during handling and imaging. The overcoating layer preferably adheres strongly to the softenable layer to minimize damage. The overcoating layer can also have abhesive properties at its outer surface which provide improved resistance to toner filming during toning, transfer, and/or cleaning. The abhesive properties can be inherent in the overcoating layer or can be imparted to the overcoating layer by incorporation of another layer or component of abhesive material. These abhesive materials should not degrade the film forming components of the overcoating and preferably have a surface energy of less than about 20 ergs/cm$^2$. Typical abhesive materials include fatty acids, salts and esters, fluorocarbons, silicones, and the like. The coatings can be applied by any suitable technique such as draw bar, spray, dip, melt, extrusion or gravure coating. It will be appreciated that these overcoating layers protect the imaging member before imaging, during imaging, after the members have been imaged.

Figure 2:
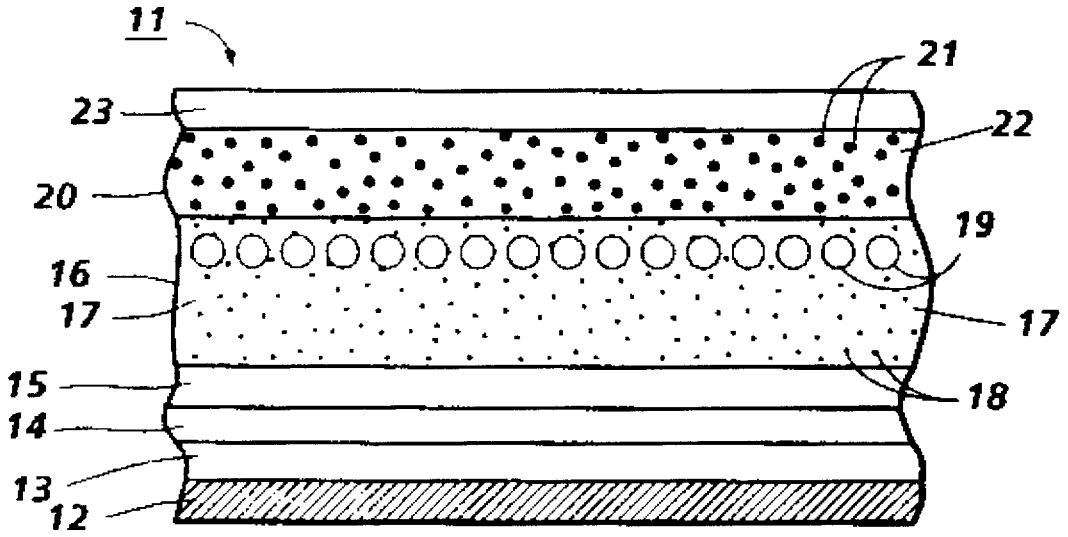
FIGS. 2 and 3 illustrate schematically embodiments of infrared-sensitive migration imaging members suitable for the process of the present invention.

FIG. 2 illustrates schematically another migration imaging member suitable for the process of the present invention. As illustrated schematically in FIG. 2, migration imaging member 11 comprises in the order shown a substrate 12, an optional adhesive layer 13 situated on substrate 12, an optional charge blocking layer 14 situated on optional adhesive layer 13, an optional charge transport layer 15 situated on optional charge blocking layer 14, a softenable layer 16 situated on optional charge transport layer 15, said softenable layer 16 comprising softenable material 17, charge transport material 18, and migration marking material 19 situated at or near the surface of the layer spaced from the substrate, and an infrared or red light radiation sensitive layer 20 situated on softenable layer 16 comprising infrared or red light radiation sensitive pigment particles 21 optionally dispersed in polymeric binder 22. Alternatively (not shown), infrared or red light radiation sensitive layer 20 can comprise infrared or red light radiation sensitive pigment particles 21 directly deposited as a layer by, for example, vacuum evaporation techniques or other coating methods. Optional overcoating layer 23 is situated on the surface of imaging member 11 spaced from the substrate 12.

Figure 3:
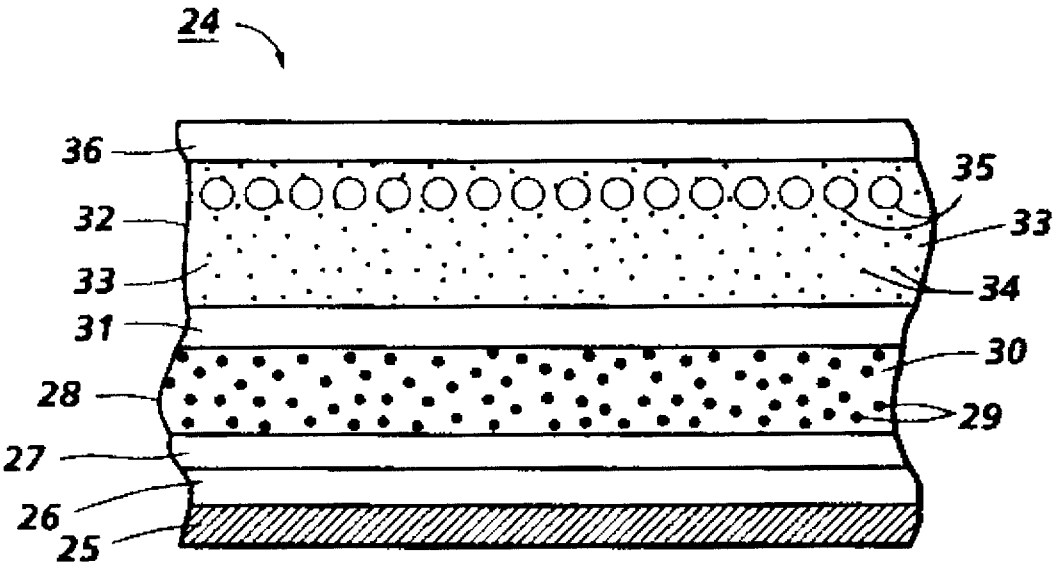

FIG. 3 illustrates schematically yet another migration imaging member suitable for the process of the present invention. As illustrated schematically in FIG. 3, migration imaging member 24 comprises in the order shown a substrate 25, an optional adhesive layer 26 situated on substrate 25, an optional charge blocking layer 27 situated on optional adhesive layer 26, an infrared or red light radiation sensitive layer 28 situated on optional charge blocking layer 27 comprising infrared or red light radiation sensitive pigment particles 29 optionally dispersed in polymeric binder 30, an optional charge transport layer 31 situated on infrared or red light radiation sensitive layer 28, and a softenable layer 32 situated on optional charge transport layer 31, said softenable layer 32 comprising softenable material 33, charge transport material 34, and migration marking material 35 situated at or near the surface of the layer spaced from the substrate. Optional overcoating layer 36 is situated on the surface of imaging member 24 spaced from the substrate 25.

The infrared or red light sensitive layer generally comprises a pigment sensitive to infrared and/or red light radiation. While the infrared or red light sensitive pigment may exhibit some photosensitivity in the wavelength to which the migration marking material is sensitive, it is preferred that photosensitivity in this wavelength range be minimized so that the migration marking material and the infrared or red light sensitive pigment exhibit absorption peaks in distinct, different wavelength regions. This pigment can be deposited as the sole or major component of the infrared or red light sensitive layer by any suitable technique, such as vacuum evaporation or the like. An infrared or red light sensitive layer of this type can be formed by placing the pigment and the imaging member comprising the substrate and any previously coated layers into an evacuated chamber, followed by heating the infrared or red light sensitive pigment to the point of sublimation. The sublimed material recondenses to form a solid film on the imaging member. Alternatively, the infrared or red light sensitive pigment can be dispersed in a polymeric binder and the dispersion coated onto the imaging member to form a layer. Examples of suitable red light sensitive pigments include perylene pigments such as benzimidazole perylene, dibromoanthranthrone, crystalline trigonal selenium, beta-metal free phthalocyanine, azo pigments, and the like, as well as mixtures thereof. Examples of suitable infrared sensitive pigments include X-metal free phthalocyanine, metal phthalocyanines such as vanadyl phthalocyanine, chloroindium phthalocyanine, titanyl phthalocyanine, chloroaluminum phthalocyanine, copper phthalocyanine, magnesium phthalocyanine, and the like, squaraines, such as hydroxy squaraine, and the like as well as mixtures thereof. Examples of suitable optional polymeric binder materials include polystyrene, styrene-acrylic copolymers, such as styrene-hexylmethacrylate copolymers, styrene-vinyl toluene copolymers, polyesters, such as PE-200, available from Goodyear, polyurethanes, polyvinylcarbazoles, epoxy resins, phenoxy resins, polyamide resins, polycarbonates, polyterpenes, silicone elastomers, polyvinylalcohols, such as Gelvatol 20-90, 9000, 20-60, 6000, 20-30, 3000, 40-20, 40-10, 26-90, and 30-30, available from Monsanto Plastics and Resins Co., St. Louis, Mo., polyvinylformals, such as Formvar 12/85, 5/95E, 6/95E, 7/95E, and 15/95E, available from Monsanto Plastics and Resins Co., St. Louis, Mo., polyvinylbutyrals, such as Butvar B-72, B-74, B-73, B-76, B-79, B90, and B-98, available from Monsanto Plastics and Resins Co., St. Louis, Mo. Zeneca resin A622, available from Zeneca Colours, Wilmington, Del., and the like as well as mixtures thereof. When the infrared or red light sensitive layer comprises both a polymeric binder and the pigment, the layer typically comprises the binder in an amount of from about 4 to about 96 percent by weight and the pigment in an amount of from about 4 to about 96 percent by weight, although the relative amounts can be outside this range. Preferably, the infrared or red light sensitive layer comprises the binder in an amount of from about 70 to about 96 percent by weight and the pigment in an amount of from about 4 to about 30 percent by weight. Optionally, the infrared sensitive layer can contain a charge transport material as described herein when a binder is present; when present, the charge transport material is generally contained in this layer in an amount of from about 5 to about 30 percent by weight of the layer. The optional charge transport material can be incorporated into the infrared or red light radiation sensitive layer by any suitable technique. For example, it can be mixed with the infrared or red light radiation sensitive layer components by dissolution in a common solvent. If desired, a mixture of solvents for the charge transport material and the infrared or red light sensitive layer material can be employed to facilitate mixing and coating. The infrared or red light radiation sensitive layer mixture can be applied to the substrate by any conventional coating process. Typical coating processes include draw bar coating, spray coating, extrusion, dip coating, gravure roll coating, wire-wound rod coating, air knife coating, and the like. An infrared or red light sensitive layer wherein the pigment is present in a binder can be prepared by dissolving the polymer binder in a suitable solvent, dispersing the pigment in the solution by ball milling, coating the dispersion onto the imaging member comprising the substrate and any previously coated layers, and evaporating the solvent to form a solid film. When the infrared or red light sensitive layer is coated directly onto the softenable layer containing migration marking material, preferably the selected solvent is capable of dissolving the polymeric binder for the infrared or red sensitive layer but does not dissolve the softenable polymer in the layer containing the migration marking material. One example of a suitable solvent is isobutanol with a polyvinyl butyral binder in the infrared or red sensitive layer and a styrene/ethyl acrylate/acrylic acid terpolymer softenable material in the layer containing migration marking material. The infrared or red light sensitive layer can be of any effective thickness. Typical thicknesses for infrared or red light sensitive layers comprising a pigment and a binder are from about 0.05 to about 2 microns, and preferably from about 0.1 to about 1.5 microns, although the thickness can be outside these ranges. Typical thicknesses for infrared or red light sensitive layers consisting of a vacuum-deposited layer of pigment are from about 200 to about 2,000 Angstroms, and preferably from about 300 to about 1,000 Angstroms, although the thickness can be outside these ranges.

Figure 4:
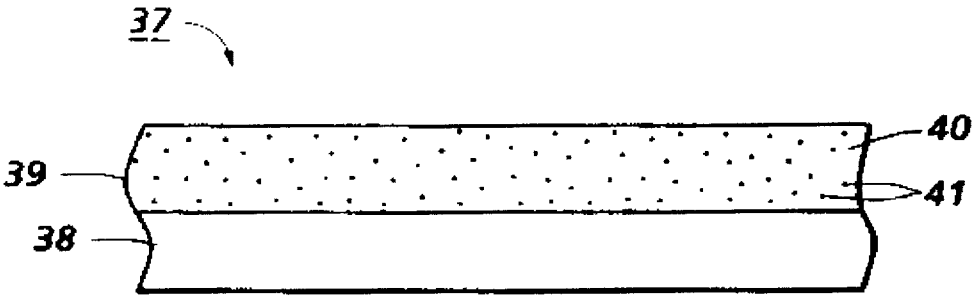
FIG. 4 illustrates schematically one embodiment of a printing plate precursor suitable for the process of the present invention.

Illustrated schematically in FIG. 4 is one embodiment of a printing plate precursor suitable for the process of the present invention. As illustrated schematically in FIG. 4, printing plate precursor 37 comprises a base layer 38 and a photosensitive layer 39 comprising a photohardenable or photosoftenable material 40 situated on base layer 38. Photohardenable or photosoftenable material 40 optionally can contain a charge transport material 41.

The base layer of the printing plate precursor employed in the processes of the present invention can be of an electrically conductive material. When conductive, this layer can comprise any suitable conductive material, including copper, brass, nickel, zinc, chromium, stainless steel, conductive plastics and rubbers, aluminum, semitransparent aluminum, steel, cadmium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like, as well as insulating materials such as paper, glass, plastic, polyesters such as Mylar® (available from E. I. Du Pont de Nemours & Company)/or Melinex® 442, (available from ICI Americas, Inc.), and the like, upon which is contained a conductive coating, such as vacuum-deposited metallized plastic, including titanized or aluminized Mylar® polyester. While the base layer typically is hydrophobic, this characteristic is not necessary, and the base layer can also be hydrophilic, such as aluminum. The base layer is of any effective thickness, generally from about 0.25 to about 30 mils, and preferably from about 2 to about 20 mils, although the thickness can be outside these ranges.

Alternatively, the base layer can be of an electrically insulating material. When the base layer is insulating, in embodiments of the present invention in which the migration imaging member is caused to adhere to the printing plate precursor prior to exposing and developing the migration imaging member, the layer of softenable material is charged during the imaging process by applying charge of one polarity to the surface of the softenable layer of the migration imaging member and applying a charge of the opposite polarity to the base layer of the printing plate precursor. Examples of suitable insulating materials include paper, glass, plastic, polyesters such as Mylar® (available from E. I. Du Pont de Nemours & Company) or Melinex® 442 (available from ICI Americas, Inc.), and the like.

Type II bimetallic plates generally have a solid copper or brass hydrophobic base layer and are electroplated on one side with chromium, which is hydrophilic, as disclosed in, for example, *The Lithographer's Manual,* 7th Ed., R. N. Blair, ed., page 10:26, Graphic Arts Technical Foundation, Pittsburgh (1983); *The Printing Industry*, V. Strauss, page 264, Printing Industries of America, in association with R. R. Bowker Company, New York (1965); and *Printing Fundamentals*, A. Glassman, Ed., page 25, TAPPI Press, Atlanta (1985). Trimetallic plates generally have a hydrophilic base layer of zinc, steel, stainless steel, aluminum, or the like that is electroplated first with copper (which is hydrophobic) and then with chromium (which is hydrophilic), as disclosed in, for example, *The Lithographer's Manual,* 7th Ed., R. N. Blair, ed., page 10:26, Graphic Arts Technical Foundation, Pittsburgh (1983).

The base material is capable of supporting good quality photomechanical coatings to be used in the lithographic process. The need for good dimensional stability increases as the size of the plate and the quality and registration requirements increase.

To the base layer is applied a layer of photosensitive material which is either photohardenable or photos oftenable. A photohardenable material is capable of becoming hardened upon exposure to light. Generally, hardening occurs upon exposure to light within the ultraviolet wavelength region, although materials capable of becoming hardened by exposure to radiation in other wavelength ranges, such as visible light, are also suitable. By "hardenable" is meant that the material undergoes a change upon exposure to light that alters its solubility characteristics in at least one solvent, so that material exposed to light is not soluble in the solvent, whereas material that has not been exposed to light can be dissolved in the same solvent. Many photohardenable materials are known in the printing art and are suitable for use in the present invention. Examples of suitable photohardenable materials include materials such as gelatin, glue, gum arabic, synthetic polymers, or the like sensitized with materials such as diazo compounds, aromatic azido compounds, dichromates, or the like; photopolymers which become crosslinked upon exposure to incident radiation, generally in the presence of photoinitiators, such as polyesters such as polycarboxylates, polycarbonates, polysulfonates, or cinnamic acid esters, including those of epoxy resins modified with hydrocarbons, amines, nitro compounds, ketones, quinones, or other organic compounds; and the like. Preferred materials include the sensitizer N-(4'-methylbenzenesulfonyl)-imino-2,5-diethoxybenzoquinone-(1,4)-diazide-4 dispersed in polyacrylic acid; the sensitizer Diazon-9 (available from Molecular Rearrangement, Inc., Newton, N.J.) dispersed in polyvinyl butyral; polyterpenes such as Nirez 1085, 1100, 1115, 1125, and 1135 (available from Reichhold Chemicals, Pensacola, Fla.); alpha -methyl styrene-vinyl toluene copolymers such as Piccotex 15, 100, 120, and LC (available from Hercules, Inc., Wilmington, Del.); modified terpene hydrocarbon resins such as Zonatac 85, 105, and 115 (available from Arizona Chemical Company, Wade, N.J.); polyterpene resins such as Zonarez 7055, 7070, 7085, 7100, 7115, and 7125 (available from Arizona Chemical Company, Wade, N.J.); polyvinyl butyral doped with sensitizers such as the diazonium compounds of 4-amino-1(N-methyl-6-naphthalene-tetrahydride- 1,2,3,4)-aminobenzene, 4",4'"-diamino-2",2'"-disulfo-1",1'"-N,N-diphenyl-4,4'-diamino-1,1'-diphenyl, 4"-amino-2"-carboxyl-1"-N-phenyl-4,4'-diamino-1,1'-diphenylmethane, or the like; vinyl alkyl ether/maleic anhydride copolymers doped with a diazonium compound such as 4-amino-2,5-diethoxy benzenediazonium chloride, polyacrylic acid, polymethacrylic acid containing a diphenylamine-4-diazonium chloride such as 4'-bromodiphenylamine-4-diazonium chloride, or containing 2-methoxycarbazole-3-diazonium bromide; polyvinyl alcohol containing diazonium metal double salts of o-methoxy-p-aminodiphenylamine and the tetrazonium metal double salts of 1,1'-diethylbenzidene, o,o'-dimethylbenzidine, and dianisidine; polyacrylamide or copolymers of acrylic acid and acrylonitrile doped with aromatic azido compounds such as 4'-azido-4-azidobenzalacetophenone-2-sulfonic acid or 4-azidobenzalacetophenone-2-sulfonic acid; butadiene copolymers sensitized with aryl azido compounds such as p-azidobenzophenone and 4,4'-diazidobenzophenone; vinyl/maleic acid copolymers doped with p-quinone diazides such as benzoquinone-(1,4)-diazide-(4)-2-sulfonic acid- beta-naphthylamide; polyacrylic acid or polymethacrylic acid doped with aminoquinone diazides such as N-(4'-methyl-benzenesulfonyl)-imino-2,5 -diethoxybenzoquinone-(1,4)-diazide-4; and the like. Particularly preferred photohardenable materials also include photopolymers because of their relatively long shelf life, relative insensitivity to temperature and humidity, excellent abrasion resistance, and long run life.

Photohardenable materials are widely used in conventional printing plates. Additional information concerning printing plates and printing processes, including the use of photohardenable materials as printing plate components, is disclosed in, for example, *The Lithographers Manual*, 7th Edition, R. N. Blair, Ed., pages 10:1 to 10:34, Graphic Arts Technical Foundation, Pittsburgh, Pa. (1983); *Light-Sensitive Systems: Chemistry and Application of Nonsilver Halide Photographic Processes*, J. Kosar, pages 321 to 357, John Wiley & Sons, New York (1965); *The Printing Industry*, V. Strauss, pages 259 to 268, Printing Industries of America, New York (1967); *Photographic Systems for Engineers*, F. M. Brown et al., Eds., pages 10 to 13, Society of Photographic Scientists and Engineers, Washington, D.C. (1966); and *Printing Fundamentals*, A. Glassman, Ed., pages 23 to 36, TAPPI Press, Atlanta (1985), the disclosures of each of which are totally incorporated herein by reference. In addition, further information concerning printing plates, printing processes, and photohardenable materials is disclosed in, for example, U.S. Pat. Nos. 3,030,208, 3,453,237, 3,622,320, 2,791,504, 3,860,426, 4,777,115, 4,758,500, 4,816,379, 4,822,723, 3,175,906, 3,046,118, 2,063,631,2,667,415, 3,867,147, 3,679,419, 4,828,963, 4,830,953, 4,423,135, 4,369,246, 4,323,637, 4,323,636, 2,714,066, 2,826,501, 4,859,551, and 2,649,373, the disclosures of each of which are totally incorporated herein by reference.

In addition to photohardenable materials, which are negative working (provide a negative image of the original), photodegradable materials may also be used, which are positive working (provide a positive image of the original). The layer of photohardenable or photodegradable material is of an effective thickness, generally from about 0.1 to about 500 microns, although the thickness can be outside of this range.

The photohardenable or photosoftenable material on the base layer of the printing plate precursor optionally can contain a charge transport material. The charge transport material can be incorporated into the photosoftenable or photohardenable layer by any suitable technique. For example, it can be mixed with the photosoftenable or photohardenable layer components by dissolution in a common solvent. If desired, a mixture of solvents for the charge transport material and the photohardenable or photosoftenable layer material can be employed to facilitate mixing and coating. The charge transport molecule and photosoftenable or photohardenable layer mixture can be applied to the base layer by any conventional coating process. Typical coating processes include draw bar coating, spray coating, extrusion, dip coating, gravure roll coating, wire-wound rod coating, air knife coating, and the like. Charge transport molecules suitable for the photohardenable or photosoftenable layer of the printing plate precursor are described in detail hereinabove. The specific charge transport molecule utilized in the photohardenable or photosoftenable layer of any given printing plate precursor can be identical to or different from any charge transport molecule employed in the migration imaging member. Similarly, the concentration of the charge transport molecule utilized in the photohardenable or photosoftenable layer of any given printing plate precursor can be identical to or different from the concentration of any charge transport molecule employed in the migration imaging member. The amount of charge transport material used in the photohardenable or photosoftenable layer can vary depending upon the particular charge transport material and its compatibility (e.g. solubility) in the other materials of the photohardenable or photosoftenable layer. Satisfactory results have been obtained using between about 5 percent and about 50 percent based on the total weight of the photohardenable or photosoftenable layer, although the amount can be outside this range.

A printing plate is prepared according to the process of the present invention by first forming an image in the softenable layer of the migration imaging member, followed by exposing the photosensitive layer of the printing plate precursor to radiation through the imaged migration imaging member. The steps of the present invention can be carried out in any desired order. For example, an unimaged migration imaging member can first be laminated to a printing plate precursor, followed by exposing and developing the migration imaging member, and subsequently followed by exposing the photosensitive layer of the printing plate precursor. Alternatively, the migration imaging member can first be exposed and developed, followed by laminating the developed migration imaging member to the printing plate precursor, and subsequently followed by exposing the photosensitive layer of the printing plate precursor. Additionally, the migration imaging member can first be exposed, followed by laminating the exposed but undeveloped migration imaging member to the printing plate precursor, followed by developing the migration imaging member, and subsequently followed by exposing the photosensitive layer of the printing plate precursor. Further, the migration imaging member can first be exposed, followed by substantially simultaneously developing the migration imaging member and laminating the exposed migration imaging member to the printing plate precursor, and subsequently followed by exposing the photosensitive layer of the printing plate precursor.

One embodiment of a process of the present invention is illustrated schematically in FIGS. 5A and 5B through 12A and 12B. As illustrated schematically in FIGS. 5A and 5B, a migration imaging member comprising a conductive substrate layer 2 and a softenable layer 6 comprising a softenable material 7, migration marking material 8, and optional first charge transport material 9 (which in the illustrated embodiment transports holes, i.e., positive charges) is laminated to a printing plate precursor comprising base layer 38 and photosensitive layer 39 comprising photohardenable material 40. Alternatively (not shown), material 40 can be a photosoftenable or photodegradable material. The photohardenable material 40 in FIGS. 5B, 6B, 7B, 8B, 9B, 10B, 11B, And 12B also contains optional second charge transport material 41 (which in the illustrated embodiment transports holes, i.e., positive charges). The softenable layer 6 is placed in contact with photosensitive layer 39 and the "sandwich" thus formed is subjected to heat and pressure by passing it through a nip created by roller 51 and roller 52. Heating can be accomplished by heating one or both of rollers 51 and 52. Alternatively (not shown), a heating element may be situated so as to heat the "sandwich" before it passes through the nip created by rollers 51 and 52. Rollers 51 and 52 are situated with respect to each other so as to form a nip, such that pressure is applied to softenable layer 6 and photosensitive layer 39 while they are in intimate contact with each other. Thereafter, subsequent to exiting the nip formed by rollers 51 and 52, photosensitive layer 39 adheres to softenable layer 6. The temperature of rollers 51 and 52 and the pressure in the nip created by rollers 51 and 52 is selected so that photohardenable layer 39 adheres to whichever layer is situated topmost on substrate 2 subsequent to exiting the nip. Preferred temperatures for rollers 51 and/or 52 typically are from about 80° to about 130° C., and more preferably from about 90° C. to about 120° C., although the temperature can be outside these ranges. Preferred pressures within the nip between rollers 51 and 52 typically are from about 5 to about 100 pounds per square inch, although the pressure can be outside this range.

Figure 6B:
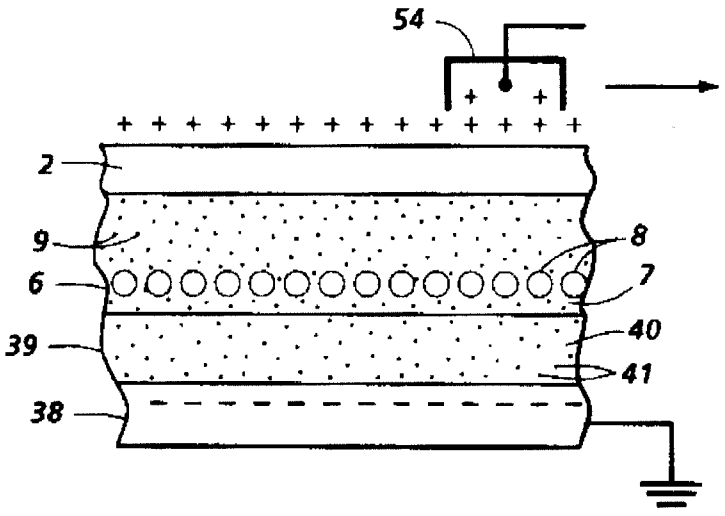
Figure 6A:
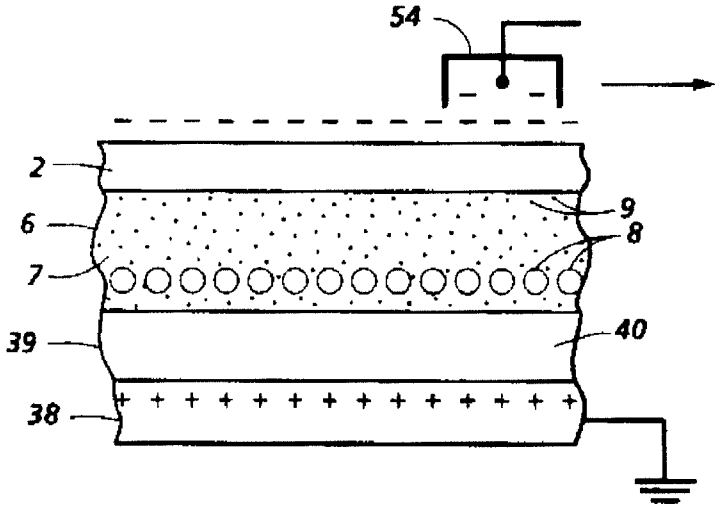

Subsequently, as illustrated schematically in FIGS. 6A and 6B, the base layer 38 of the printing plate precursor, which is conductive in this illustrated embodiment, is connected to a reference potential such as a ground and the migration imaging member-printing plate precursor sandwich is uniformly charged in the dark (negative charging is illustrated in FIG. 6A, positive charging is illustrated in FIG. 6B) by a charging means 54 such as a corona charging apparatus.

Figure 7B:
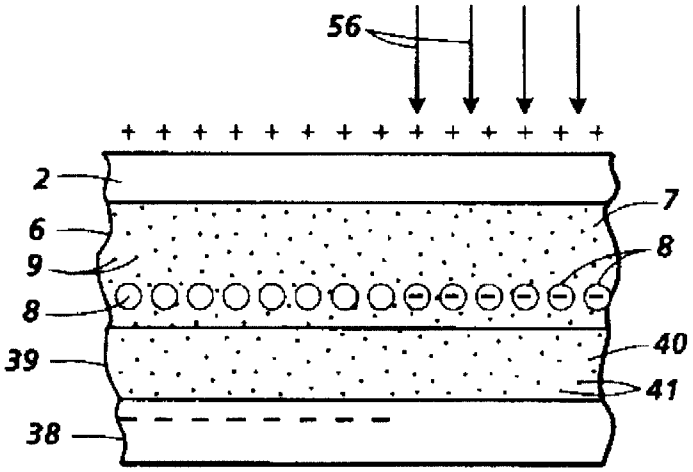
Figure 7A:
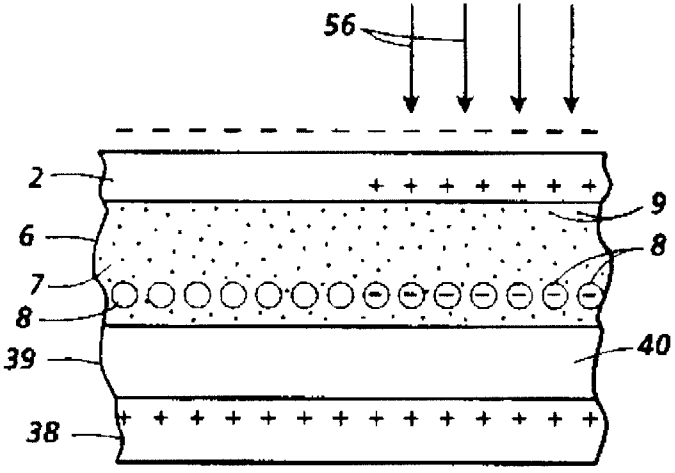

As illustrated schematically in FIGS. 7A and 7B, the charged member is then exposed imagewise to radiation 56 at a wavelength to which the migration marking material 8 is sensitive. For example, when the migration marking material is selenium particles, blue or green light can be used for imagewise exposure. Substantial photodischarge then occurs in the exposed areas.

Figure 8B:
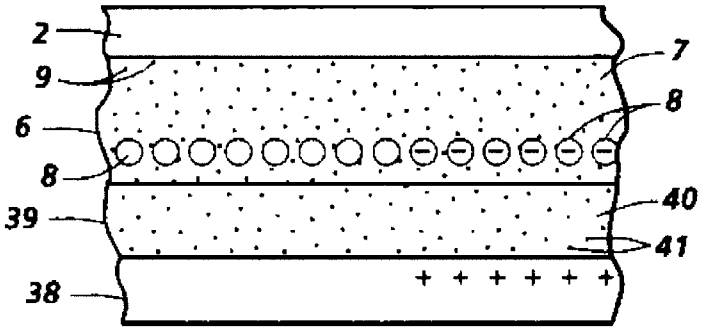
Figure 8A:
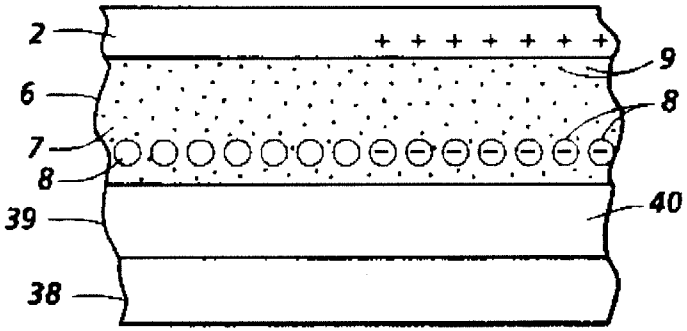

As illustrated schematically in FIGS. 8A and 8B, the exposed member is then recharged to a polarity opposite to that with which the migration imaging member-printing plate precursor sandwich was initially charged to place the applied field in the correct direction to enable particle migration.

Figure 9B:
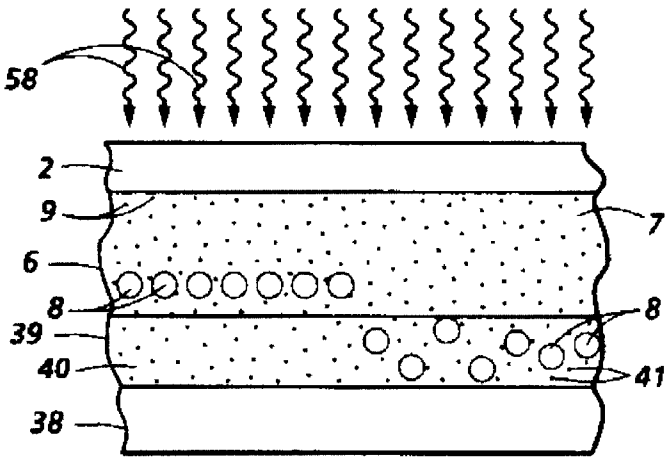
Figure 9A:
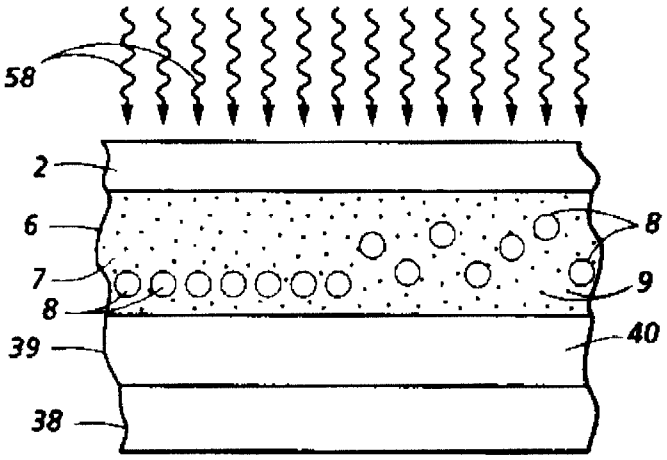

Thereafter, as illustrated schematically in FIGS. 9A and 9B, subsequent to formation of a charge image pattern in the migration marking material, the image is developed by causing the softenable material 7 to soften by any suitable means (in FIGS. 9A and 9B, by uniform application of heat energy 58 to the softenable layer 6). The heat development temperature and time depend upon factors such as how the heat energy is applied (e.g. conduction, radiation, convection, and the like), the melt viscosity of the softenable layer, thickness of the softenable layer, the amount of heat energy, and the like. For example, at a temperature of 110° C. to about 130° C., heat need only be applied for a few seconds. For lower temperatures, more heating time can be required. When the heat is applied, the softenable material 7 decreases in viscosity, thereby decreasing its resistance to migration of the marking material 8 through the softenable layer 6. As shown in FIG. 9A, in areas of the imaging member wherein the migration marking material has a substantial net charge, upon softening of the softenable material 7, the net charge causes the charged marking material to migrate in image configuration toward substrate 2 and disperse or agglomerate in the softenable layer 6, resulting in a $D_{min}$ area. The uncharged migration marking particles in areas of the imaging member remain essentially neutral and uncharged. Thus, in the absence of migration force, the unexposed migration marking particles remain substantially in their original position in softenable layer 6, resulting in a $D_{max}$ area. As shown in FIG. 9B, in the embodiment wherein photohardenable layer 39 contains charge transport material 41, the migration marking particles that are charged migrate in depth through softenable layer 6 and photohardenable layer 39 toward the base layer 38 and disperse or agglomerate in photohardenable layer 38, resulting in a $D_{min}$ area. The uncharged migration marking particles in areas of the imaging member remain essentially neutral and uncharged. Thus, in the absence of migration force, the unexposed migration marking particles remain substantially in their original positions in softenable layer 6, resulting in a $D_{max}$ area. In the embodiment illustrated in FIG. 9B, the "sandwich" is heated to a temperature sufficient to lower the viscosity of both photohardenable material 40 and softenable material 7 sufficiently to allow migration of migration marking particles 8 through both layers. In addition, the photohardenable material is selected so that it does not degrade or decompose at the development temperature.

If desired, solvent vapor development can be substituted for heat development. Vapor development of migration imaging members is well known in the art. Generally, if solvent vapor softening is utilized, the solvent vapor exposure time depends upon factors such as the solubility of the softenable layers in the solvent, the type of solvent vapor, the ambient temperature, the concentration of the solvent vapors, and the like.

The application of either heat, or solvent vapors, or combinations thereof, or any other suitable means should be sufficient to decrease the resistance of the softenable material 7 of softenable layer 6 (and, in the embodiment illustrated in FIGS. 5B, 6B, 7B, 8B, 9B, 10B, 11B, and 12B, the resistance of photohardenable material 40 containing second charge transport material 41) to allow migration of the migration marking material 8 through softenable layer 6 (and, in the embodiment illustrated in FIGS. 5B, 6B, 7B, 8B, 9B, 10B, 11B, and 12B, the migration of migration marking material 8 through photosensitive layer 39 containing photohardenable material 40 and second charge transport material 41) in imagewise configuration. With heat development, satisfactory results can be achieved by heating the imaging member to a temperature of about 100° C. to about 130° C. for only a few seconds when the softenable layer contains an 80/20 mole percent copolymer of styrene and hexylmethacrylate having an intrinsic viscosity of 0.179 dl/gm and N,N'-diphenyl-N,N'-bis(3"-methylphenyl)-(1,1'-biphenyl)-4,4'-diamine. The test for a satisfactory combination of time and temperature is to maximize optical contrast density. With vapor development, satisfactory results can be achieved by exposing the imaging member to the vapor of toluene for between about 4 seconds and about 60 seconds at a solvent vapor partial pressure of between about 5 millimeters and 30 millimeters of mercury when the softenable layer contains an 80/20 mole percent copolymer of styrene and hexylmethacrylate having an intrinsic viscosity of 0.179 dl/gm and N,N'-diphenyl-N,N'-bis(3"-methylphenyl)-(1,1'-biphenyl)-4,4'-diamine.

The migration imaging member on the printing plate precursor having an imaged softenable layer shown in FIGS. 9A and 9B is transmitting to light in the migrated region because of the depthwise migration and dispersion of the migration marking material in this region. The $D_{max}$ in the unmigrated region generally is essentially the same as the original unprocessed softenable layer because the positions of migration marking particles in the unmigrated regions remain essentially unchanged. Thus, optically sign-retained images with high optical contrast density in the region of 0.9 to 1.2 can be achieved. In addition, exceptional resolution, such as 228 line pairs per millimeter, can be achieved in the imaged softenable layer.

If desired, the imaging member as shown in FIG. 9A or 9B can be used for a color printing process by a method similar to the xeroprinting process disclosed in, for example, U.S. Pat. Nos. 5,215,838 and 4,970,130, the disclosures of each of which are totally incorporated herein by reference. Specifically, the color proofing process entails (1) uniformly charging the imaging member to the desired polarity; (2) uniformly exposing the charged imaging member to activating radiation at a wavelength to which the migration marking material is sensitive (for example, blue-green light for selenium particles), thereby forming an electrostatic latent image on the surface of the imaging member; (3) developing the electrostatic latent image with a toner of a first color; (4) transferring the developed image of the first color to a substrate and optionally affixing it thereto; and (5) repeating steps (1) through (4) for each additional color in the final image (for example, applying cyan, magenta, yellow, and black images to the substrate in this manner) to produce a color proof. Subsequent to this proofing process, the imaging member may be employed as illustrated in FIGS. 10A and 10B and FIGS. 11A and 11B.

Figure 10B:
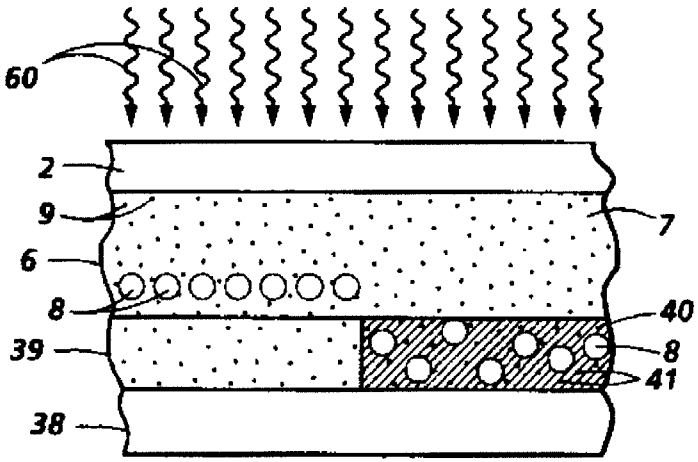
Figure 10A:
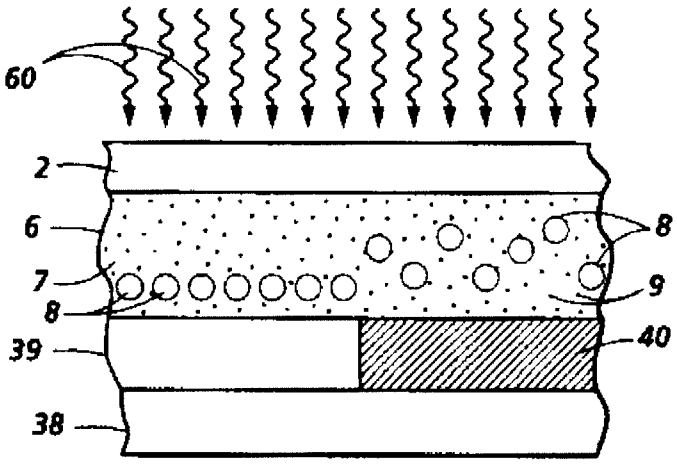

Thereafter, as illustrated schematically in FIGS. 10A and 10B, the photohardenable layer 39 of the printing plate precursor is then exposed to light 60 at a wavelength capable of causing the photohardenable material 40 to harden in areas exposed to light through the migrated areas within softenable layer 6 of the migration imaging member. Typically, photohardenable materials employed in conventional printing plates can become hardened by exposure to light in the ultraviolet wavelength region, although photohardenable materials that harden upon exposure to energy in other wavelength regions can also be selected. Exposure of the photohardenable material is for any length of time and at any level of incident radiation sufficient to cause hardening of the photohardenable material. For example, photohardenable materials frequently employed for conventional printing plates, such as Azoplate (available from Hoechst), KPR (available from Eastman Kodak Company), or the like, typically can be hardened by exposure to ultraviolet light through the imaged softenable layer at an exposure level of from about $10^3$ to about $10^6$ ergs per square centimeter for a time period of from about 30 to about 180 seconds. Exposure of photohardenable material 40 results in exposed areas becoming hardened and unexposed areas remaining unhardened. Any suitable source of radiation can be employed, such as carbon arc lamps, mercury vapor lamps, fluorescent lamps, tungsten lamps, photoflood lamps, or the like.

Figure 11B:
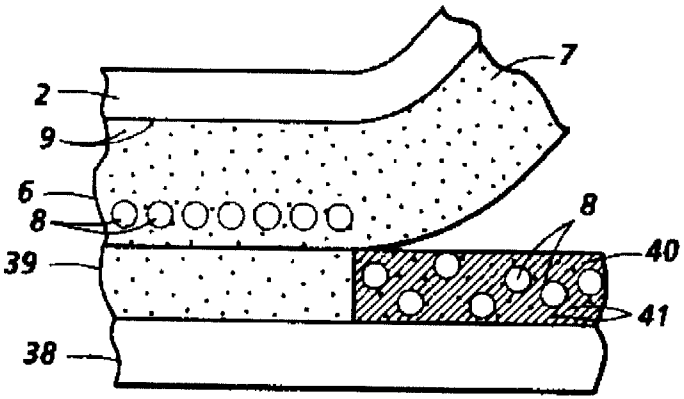

Subsequently, as illustrated schematically in FIGS. 11A and 11B, the imaged migration imaging member is removed from the exposed printing plate by any suitable method, such as by peeling the two layers apart. As shown, unhardened photohardenable material remains adhered to the softenable material of the migration imaging member, while hardened photohardenable material remains adhered to base layer 38. If necessary or desired, an optional release layer may be included in the imaging member between layer 6 and layer 39 to facilitate this step. Alternatively (not shown), the printing plate can be washed with a solvent in which the softenable material and the unhardened photohardenable material are relatively soluble and in which the hardened photohardenable material is relatively insoluble. Examples of suitable solvents include water, isopropyl alcohol, normal propyl alcohol, Cellosolve (ethylene glycol monoethyl ether), butyl alcohol, benzyl alcohol, solutions of aromatic sulfonic acids and their salts, acetone, methanol, methyl ethyl ketone, benzene, toluene, xylene, carbon tetrachloride, trichloroethane, trichloroethylene, methylchloroform, tetrachloroethylene, and the like as well as mixtures thereof. Washing the plate precursor results in removal from the base layer of all unhardened photohardenable material and all softenable material, resulting in formation of a printing plate comprising a base layer having thereon hardened photohardenable material in imagewise configuration in areas previously exposed to light. The washing step is well known in the printing art. Further information regarding development of an exposed printing plate by washing is disclosed in, for example, U.S. Pat. Nos. 3,860,426, 4,780,396, 4,822,723, and U.S. Pat. 4,423,135, the disclosures of each of which are totally incorporated herein by reference. FIGS. 12A and 12B illustrate schematically the printing plate thus formed by the process of the present invention. In the printing plate illustrated in FIG. 12B, the photohardened material also contains migration marking material.

Figure 13:
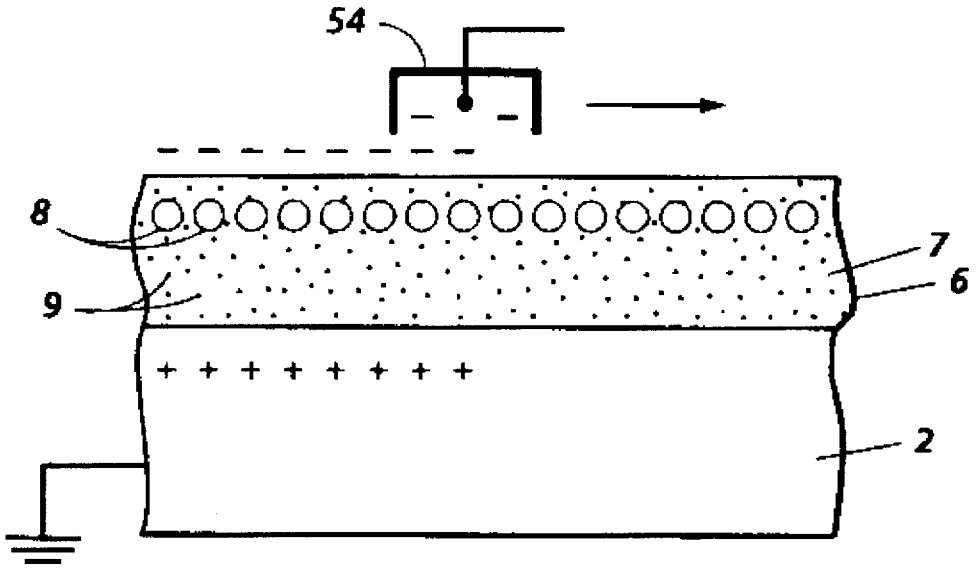
FIGS. 13, 14, and 15 illustrate schematically another process for preparing a printing plate according to the present invention.
Figure 14:
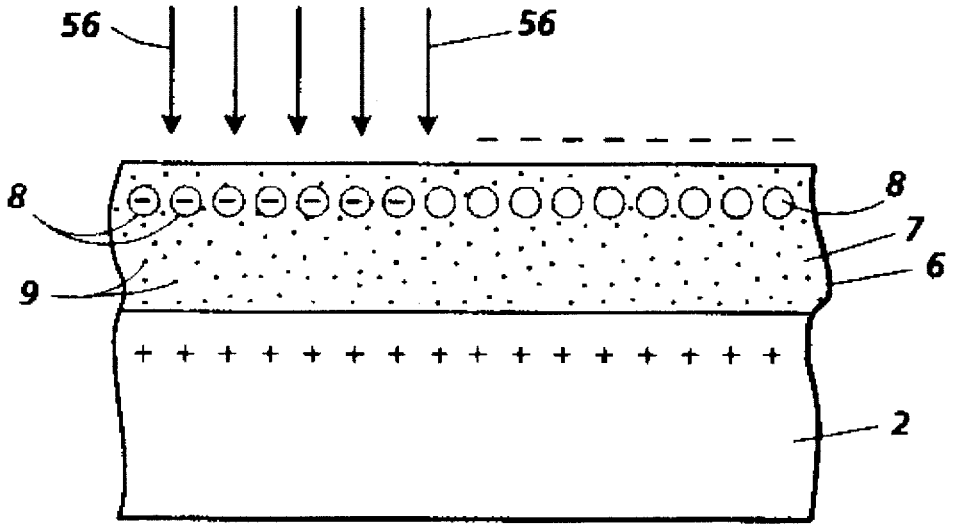
Figure 15:
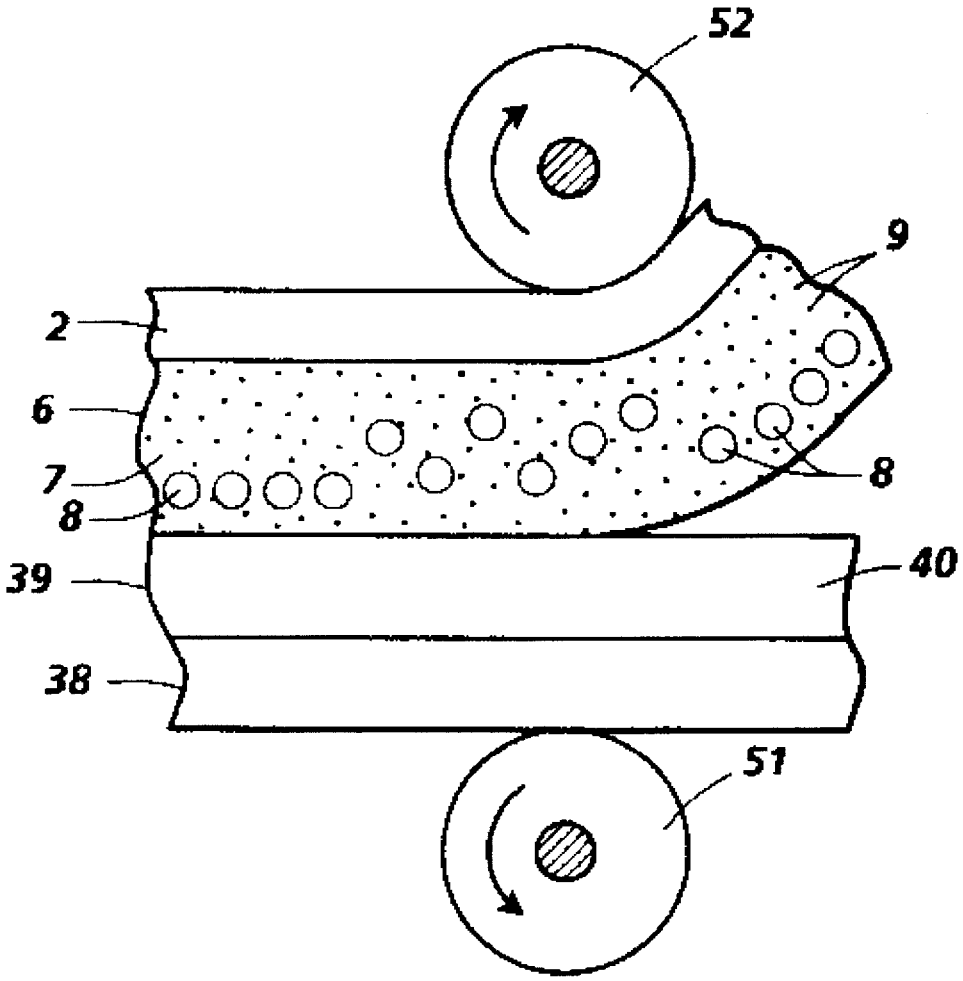

Alternatively, a printing plate can be prepared by a process of the present invention as illustrated schematically in FIGS. 13 to 15. As illustrated schematically in FIGS. 13 to 15, a migration imaging member comprising a conductive substrate layer 2 that is connected to a reference potential such as a ground, and a softenable layer 6 comprising softenable material 7, migration marking material 8, and optional charge transport material 9 is uniformly charged in the dark to either polarity (negative charging is illustrated in FIG. 13) by a charging means 54 such as a corona charging apparatus.

As illustrated schematically in FIG. 14, the charged member is then exposed imagewise to radiation 56 at a wavelength to which the migration marking material 8 is sensitive. For example, when the migration marking material is selenium particles, blue or green light can be used for imagewise exposure. Substantial photodischarge then occurs in the exposed areas.

As illustrated schematically in FIG. 15, subsequent to formation of a charge image pattern, the imaging member is simultaneously laminated to a printing plate precursor (comprising base layer 38 and photohardenable layer 39 comprising photohardenable material 40) and developed by causing the softenable material to soften by contacting photohardenable layer 39 with the surface of the migration imaging member spaced from substrate 2 (in the illustrated embodiment, contacting photohardenable layer 39 to the surface of softenable layer 6) and applying heat and pressure to the migration imaging member and printing plate precursor by passing the "sandwich" created by laying printing plate precursor onto the imaging member through a nip created by roller 51 and roller 52. Heating can be accomplished by heating one or both of rollers 51 and 52. Alternatively (not shown), a heating element may be situated so as to heat the "sandwich" before it passes through the nip created by rollers 51 and 52. Rollers 51 and 52 are situated with respect to each other so as to form a nip, such that pressure is applied to softenable layer 6 and the printing plate precursor comprising base layer 38 and photohardenable layer 39 while they are in intimate contact with each other. Thereafter, subsequent to exiting the nip formed by rollers 51 and 52, photohardenable layer 39 adheres to softenable layer 6. Application of heat and pressure in the illustrated manner causes softenable material 7 to soften, thereby enabling migration marking material 8 to migrate through softenable material 7 toward substrate 2, and also causing photohardenable layer 39 to adhere to softenable layer 6. The temperature and time depend upon factors such as the melt viscosity of the softenable layer, thickness of the softenable layer, the amount of heat energy, and the like. For example, at a temperature of 110° C. to about 130° C., heat need only be applied for a few seconds. For lower temperatures, more heating time can be required. When the heat is applied, the softenable material decreases in viscosity, thereby decreasing its resistance to migration of the marking material 8 through the softenable layer 6. As shown in FIG. 15, in areas of the imaging member wherein the migration marking material has a substantial net charge, upon softening of the softenable layer 6, the net charge causes the charged marking material to migrate in image configuration towards the substrate 2 and disperse in the softenable layer 6, resulting in a $D_{min}$ area. The uncharged migration marking particles in areas of the imaging member remain essentially neutral and uncharged. Thus, in the absence of migration force, the unexposed migration marking particles remain substantially in their original position in softenable layer 6, resulting in a $D_{max}$ area.

The temperature of rollers 51 and 52 and the pressure in the nip created by rollers 51 and 52 is selected so that photohardenable layer 39 adheres to whichever layer is situated topmost on substrate 2 (which is softenable layer 6 as illustrated in FIG. 15) subsequent to exiting the nip. Preferred temperatures for rollers 51 and/or 52 typically are from about 80° to about 130° C., and more preferably from about 90° C. to about 120° C., although the temperature can be outside these ranges. Preferred pressures within the nip between rollers 51 and 52 typically are from about 5 to about 100 pounds per square inch, although the pressure can be outside this range.

Figure 11A:
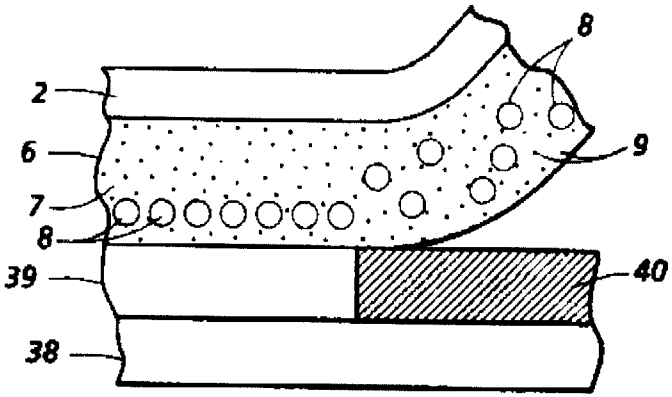
Figure 12A:
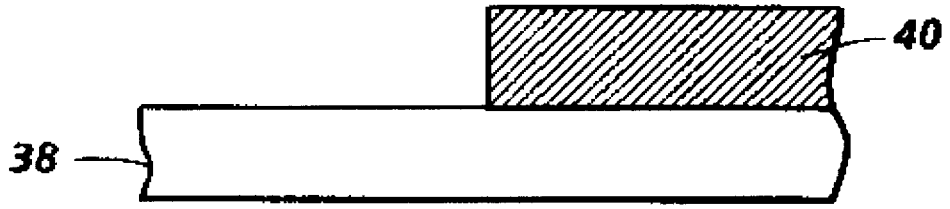
Figure 12B:
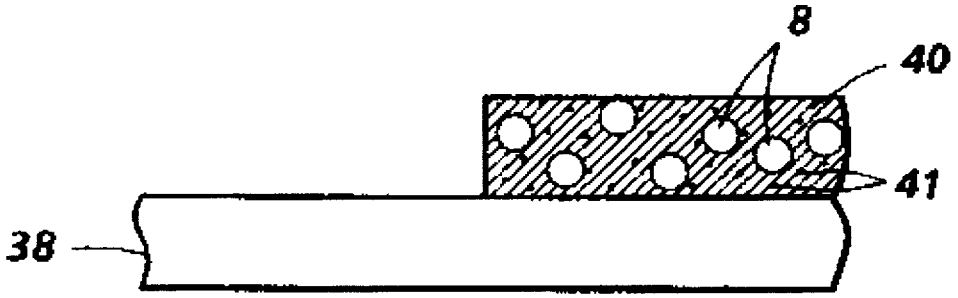

Thereafter, the process of the present invention proceeds as illustrated schematically in FIGS. 10A, 11A, and 12A.

Alternatively (not shown), the exposed migration imaging member can first be laminated to the printing plate precursor, followed by developing the image in the migration imaging member by any desired method. Further (not shown), the exposed migration imaging member can first be developed, followed by lamination of the developed migration imaging member to the printing plate precursor.

Figure 5B:
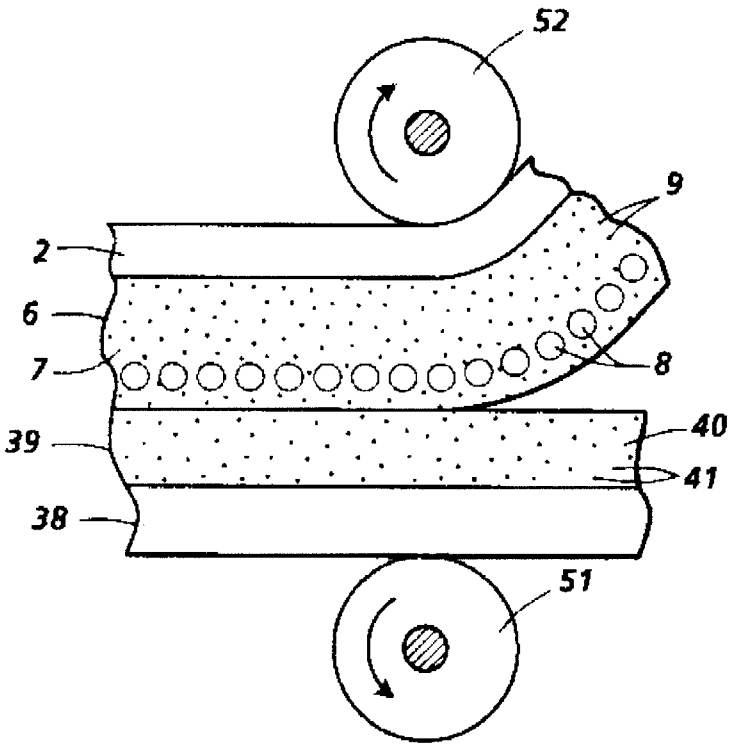
FIGS. 5A, 5B, 6A, 6B, 7A, 7B, 8A, 8B, 9A, 9B, 10A, 10B, 11A, 11B, 12A, and 12B illustrate schematically a process for preparing a printing plate according to the present invention.
Figure 5A:
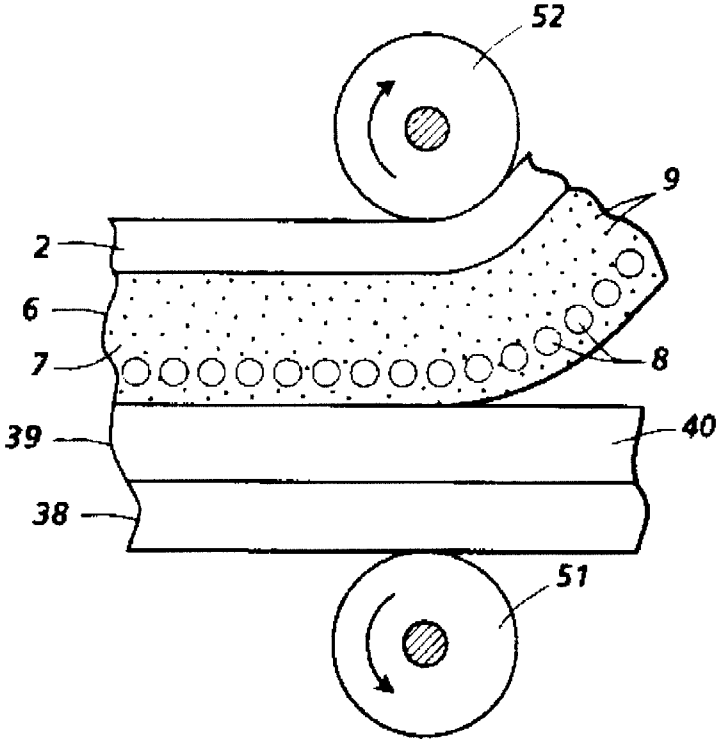

The imaging members illustrated in FIGS. 5A and 5B through are shown without any optional layers such as those illustrated in FIGS. 1, 2, and 3. If desired, alternative imaging member embodiments, such as those employing any or all of the optional layers illustrated in FIGS. 1, 2, and 3, can also be employed. Processes for imaging migration imaging members containing infrared sensitive layers are disclosed in, for example, U.S. Pat. No. 5,215,838, the disclosure of which is totally incorporated herein by reference.

The printing plate thus formed can be employed in known printing processes. For example, since the base layer typically is hydrophilic and the hardened photohardenable material typically is hydrophobic, an oil-based hydrophobic ink applied to the plate will adhere to the photohardenable material and be repelled by the base layer. The ink thus applied can be transferred directly to a printing substrate such as paper, cloth, or the like in image configuration by contacting the printing substrate directly to the plate. Alternatively, the ink can be transferred in image configuration to an intermediate transfer means, such as a roller, belt, sheet, or the like, as typically is done in lithographic processes, and the ink image can then be transferred from the intermediate transfer means to a printing substrate by contacting the intermediate transfer means to the substrate.

Other embodiments and modifications of the present invention may occur to those skilled in the art subsequent to a review of the information presented herein; these embodiments and modifications, as well as equivalents thereof, are also included within the scope of this invention.

What is claimed is:

1. A process which comprises (a) providing a migration imaging member which comprises a substrate and a softenable layer comprising a softenable material and a photosensitive migration marking material; (b) providing a printing plate precursor which comprises a base layer and a layer of photosensitive material selected from the group consisting of photohardenable materials and photosoftenable materials; (c) placing the softenable layer of the migration imaging member in contact with the layer of photosensitive material of the printing plate precursor and applying heat and pressure to the migration imaging member and printing plate precursor, thereby causing the softenable layer of the migration imaging member to adhere to the layer of photosensitive material of the printing plate precursor; (d) uniformly charging the migration imaging member; (e) subsequent to step (d), exposing the charged imaging member to activating radiation at a wavelength to which the migration marking material is sensitive; (f) subsequent to step (e), causing the softenable material to soften and enabling the migration marking material to migrate through the softenable material in an imagewise pattern, thereby resulting in the layer of softenable material becoming transmissive to light in areas where the migration marking material has migrated and remaining nontransmissive to light in areas where the migration marking material has not migrated; (g) subsequent to step (f), uniformly exposing the migration imaging member and the printing plate precursor to radiation at a wavelength to which the photosensitive material on the printing plate precursor is sensitive, thereby causing the photosensitive material on the printing plate precursor to harden or soften in areas situated contiguous with light-transmissive areas of the softenable layer, thereby forming an imaged printing plate; and (h) subsequent to step (g), removing the migration imaging member from the imaged printing plate.

2. A process according to claim 1 wherein steps (d), (e), and (f) occur subsequent to step (c).

3. A process according to claim 1 wherein step (c) occurs subsequent to steps (d) and (e) and prior to step (f).

4. A process according to claim 1 wherein step (c) occurs subsequent to steps (d) and (e) and substantially simultaneously with step (f).

5. A process according to claim 1 wherein step (c) occurs subsequent to steps (d), (e), and (f).

6. A process according to claim 1 wherein the softenable layer of the migration imaging member also contains a charge transport material.

7. A process according to claim 1 wherein the photosensitive material of the printing plate precursor is softenable, wherein the migration marking material can migrate into the photosensitive material of the printing plate precursor when said photosensitive material is softened.

8. A process according to claim 7 wherein the photosensitive material of the printing plate precursor contains a charge transport material.

9. A process according to claim 7 wherein the photosensitive material of the printing plate precursor is selected from the group consisting of polyterpenes, alpha-methyl styrene-vinyl toluene copolymers, modified terpene hydrocarbon resins, polyvinyl butyral doped with sensitizers, vinyl alkyl ether/maleic anhydride copolymers doped with a diazonium compound, polyacrylic acid, polymethacrylic acid containing a diphenylamine-4-diazonium chloride, polymethacrylic acid containing 2-methoxycarbazole-3-diazonium bromide, polyvinyl alcohol containing diazonium metal double salts of o-methoxy-p-aminodiphenylamine and the tetrazonium metal double salts of 1,1'-diethylbenzidene, o,o'-dimethylbenzidine, and dianisidine, polyacrylamide doped with aromatic azido compounds, copolymers of acrylic acid and acrylonitrile doped with aromatic azido compounds, butadiene copolymers sensitized with aryl azido compounds, vinyl/maleic acid copolymers doped with p-quinone diazides, polyacrylic acid doped with aminoquinone diazides, polymethacrylic acid doped with aminoquinone diazides, and mixtures thereof.

10. A process according to claim 1 wherein the photosensitive material of the printing plate is photohardenable.

11. A process according to claim 1 wherein the photosensitive material of the printing plate is photosoftenable.

12. A process according to claim 1 wherein the migration marking material is selenium.

13. A process according to claim 1 wherein the marking material is present in the softenable layer as a monolayer of particles situated at or near the surface of the softenable layer spaced from the substrate.

14. A process according to claim 1 wherein the migration imaging member comprises a substrate, a first softenable layer comprising a first softenable material and a first migration marking material contained at least at or near the surface of the first softenable layer spaced from the substrate, and a second softenable layer comprising a second softenable material and a second migration marking material.

15. A process according to claim 1 wherein the migration imaging member also comprises an infrared or red light radiation sensitive layer which comprises a pigment predominantly sensitive to infrared or red light radiation, wherein the migration marking material is predominantly sensitive to radiation at a wavelength other than that to which the infrared or red light sensitive pigment is sensitive.

16. A process according to claim 1 wherein the pressure applied is from about 5 to about 100 pounds per square inch.

17. A process according to claim 1 wherein the heat applied is at a temperature of from about 80° to about 130° C.

18. A process according to claim 1 wherein a release layer is situated between the softenable layer and the photohardenable or photosoftenable layer.

19. A process according to claim 1 wherein subsequent to step (f) and prior to step (g), the migration imaging member is (i) uniformly charged; (ii) subsequent to step (i), uniformly exposed to activating radiation at a wavelength to which the migration marking material is sensitive, thereby forming an electrostatic latent image; and (iii) subsequent to step (ii), developed by applying toner particles to the electrostatic latent image, and wherein the developed image is transferred to a substrate and optionally affixed thereto.

20. A process according to claim 19 wherein the toner particles in step (iii) are of a first color, and wherein subsequent to transfer of the developed image of the first color to the substrate and prior to step (g), the migration imaging member is (iv) uniformly charged; (v) subsequent to step (iv), uniformly exposed to activating radiation at a wavelength to which the migration marking material is sensitive, thereby forming an electrostatic latent image; and (vi) subsequent to step (v), developed by applying toner particles of a second color to the electrostatic latent image formed in step (v), and wherein the developed image of the second color is transferred to the substrate and optionally affixed thereto.

* * * * *